US011089818B2

(12) United States Patent
Fuisz et al.

(10) Patent No.: US 11,089,818 B2
(45) Date of Patent: Aug. 17, 2021

(54) HEATER FOR VAPORIZER DEVICE WITH AIR PREHEATING ELEMENT AND METHOD FOR PRODUCING THE SAME

(71) Applicant: Fuisz Hnb Technologies LLC, Nashville, TN (US)

(72) Inventors: Joseph Fuisz, Nashville, TN (US); Richard Fuisz, Nashville, TN (US); Anatolii Gordovskyi, Kiev (UA); Yurii Lypskyi, Zhytomyr (UA)

(73) Assignee: FUISZ HNB TECHNOLOGIES LLC, Nashville, TN (US)

( * ) Notice: Subject to any disclaimer, the term of this patent is extended or adjusted under 35 U.S.C. 154(b) by 0 days.

(21) Appl. No.: 17/061,767

(22) Filed: Oct. 2, 2020

(65) Prior Publication Data

US 2021/0212382 A1 Jul. 15, 2021

Related U.S. Application Data

(60) Provisional application No. 62/959,544, filed on Jan. 10, 2020.

(51) Int. Cl.
*H05B 1/02* (2006.01)
*A24F 40/60* (2020.01)
(Continued)

(52) U.S. Cl.
CPC ..... *A24F 40/60* (2020.01); *A24F 40/20* (2020.01); *A24F 40/70* (2020.01); *F24H 3/002* (2013.01);
(Continued)

(58) Field of Classification Search
CPC ... H05B 1/02; H05B 3/06; H05B 3/16; H05B 3/34; H05B 2203/002; H05B 2203/013;
(Continued)

(56) References Cited

U.S. PATENT DOCUMENTS 8,375,957 B2 * 2/2013 Hon ..... H01M 10/0525 131/194
2014/0190499 A1 * 7/2014 Siminszky ..... A24B 15/28 131/290

(Continued)

FOREIGN PATENT DOCUMENTS

EP 3391758 B1 10/2018

OTHER PUBLICATIONS

International Search Report and Written Opinion dated Mar. 18, 2021 in counterpart PCT/US2021/012603.

*Primary Examiner* — Mark H Paschall
(74) *Attorney, Agent, or Firm* — Fitch, Even, Tabin & Flannery, LLP

(57) ABSTRACT

A heater for a vaporizer with air preheating element includes a casing, a tunnel with a perforated bottom, which is a cylindrical heating chamber for placing a cigarette, a heating element of a resistive type, a heat exchanger, including air channels for circulation and preheating of air by a heater, a top end and a bottom end, an air intake hole made in the top end. Outlet holes are communicated with exits of air channels of the heat exchanger for intake of air preheated by the heater in the tunnel. The casing is made in the form of a tape of a thin-film dielectric heat-resistant material, on which a thin layer of resistive material with contacts is applied on the end of one side, forming the heating element, and on the other side a top and bottom spacers are fixed and inclined toward the middle, as well as the edging, which are made of flexible heat-resistant material. The above mentioned tape with a heating element, located on its external side, is rolled into a cylinder and forms a tunnel, and is additionally coiled into several interconnected spiral coils, and forms a spiral casing with the top and bottom ends so that the top and bottom spacers and the edging located on the inside form a spiral heat exchanger comprising the top and bottom and the
(Continued)

middle spiral air ducts for spiral and labyrinth circulation and preheating of air, and at the bottom there is an additional inlet hole for air intake.

22 Claims, 17 Drawing Sheets

(51) Int. Cl.

| | |
|---|---|
| ***H05B 3/06*** | (2006.01) |
| ***F24H 3/00*** | (2006.01) |
| ***H05B 3/34*** | (2006.01) |
| ***A24F 40/20*** | (2020.01) |
| ***A24F 40/70*** | (2020.01) |
| ***H05B 3/16*** | (2006.01) |
| *A24F 47/00* | (2020.01) |

(52) U.S. Cl.
CPC ..... *H05B 3/06* (2013.01); *H05B 3/16* (2013.01); *H05B 3/34* (2013.01); *H05B 2203/002* (2013.01); *H05B 2203/013* (2013.01); *H05B 2203/017* (2013.01)

(58) Field of Classification Search
CPC .... H05B 2203/017; A24F 40/60; A24F 40/70; A24F 40/20; A24F 47/008; F24H 3/002
USPC ..... 219/494, 497, 483, 486, 492; 131/328, 131/329, 194
See application file for complete search history.

(56) References Cited

U.S. PATENT DOCUMENTS

| | | | | |
|---|---|---|---|---|
| 2014/0230834 | A1 | 8/2014 | Kaljura | |
| 2014/0238425 | A1 | 8/2014 | Kaljura | |
| 2014/0345633 | A1* | 11/2014 | Talon | G01N 33/0004 131/329 |
| 2015/0258289 | A1* | 9/2015 | Henry, Jr. | A61M 11/042 128/202.21 |
| 2018/0043114 | A1* | 2/2018 | Bowen | A61M 15/003 |
| 2019/0000141 | A1 | 1/2019 | Rojo-Calderon | |
| 2019/0000144 | A1* | 1/2019 | Bless | A24F 40/50 |
| 2019/0150504 | A1 | 5/2019 | Liu | |
| 2020/0022416 | A1* | 1/2020 | Alarcon | A24F 40/53 |

* cited by examiner

HEATER FOR VAPORIZER DEVICE WITH AIR PREHEATING ELEMENT AND METHOD FOR PRODUCING THE SAME

CROSS-REFERENCE TO RELATED APPLICATION

This application is a non-provisional application that claims benefit of provisional application No. 62/959,544, filed Jan. 10, 2020, the entire content of which is incorporated herein by reference.

FIELD OF THE INVENTION

The present invention relates to smoking or vaping articles, in particular to heating systems intended for use as part of an electronic vaporizer device for vaping of cigarettes or smokable or vaporizable tobacco sticks without pyrolysis (burning, smoldering) used as part of portable or stationary electronic devices for heating of smokable or vaporizable sticks, and methods for manufacturing the same.

BACKGROUND OF THE INVENTION

Smoking articles, such as heating systems intended for use as part of an electronic vaporizer device for vaping of cigarettes/tobacco sticks without pyrolysis (burning, smoldering) that can be used as part of portable and stationary electronic devices for heating of tobacco sticks are known in the art. In its conventional embodiment, the tobacco stick comprises tobacco (often reconstituted tobacco with added vapor agent) in a cylindrical tube, typically made of paper and frequently comprising a filter. Examples include Philip Morris Products S.A.'s HEATSTICKS® used by its IQOS® devices, or the tobacco sticks used by British American Tobacco's GLO® (i.e. Neostiks™). In some heaters, when the active substance (nicotine) is evaporated from a cigarette tobacco stick, only external electric heating of the cigarette is used (i.e. the heater does not penetrate tobacco, but comes into contact with the outer part of the paper cylinder of the cigarette, which contains the tobacco substrate). An example of a commercial device where the tobacco stick is heated without penetrating the tobacco substrate is the GlO® device marketed by British American Tobacco. In other heaters, most prominently IQOS® marketed by Philip Morris International, the heating is internal to the tobacco stick, i.e. the tobacco stick is penetrated by a heated blade that is in contact with the tobacco substrate.

SUMMARY OF THE INVENTION

The form factor of tobacco stick devices presents unique challenges that have not been fully appreciated by device developers. With traditional combustible cigarettes, the smoker holds the cigarette in his/her fingers, typically at the filter, and despite the substantial temperatures achieved in the "burning" portion of the cigarette, distance and weak heat transfer properties of the cigarette materials are sufficient such that the user perceives no adverse issues associated with heat.

Moreover, the heat source is pyrolysis, providing sufficient heat for the intended purpose of combusting tobacco and tipping paper.

The structure of the heat not burn device for a tobacco stick is quite different from a combustible cigarette. The tobacco stick has relatively high heat requirements (180-400° C.) and the heater must surround or be in close contact or close proximity or direct contact with the tobacco portion of the tobacco stick. Battery and device weight make it unlikely the user will casually hold the device in two fingers away from the hot portion like a cigarette (where the hand tends to hold the cigarette away from the burning end)—that is simply not feasible with today's battery device. The device is simply too heavy, and the tobacco stick tends to lack the requisite strength even if the user wanted to hold the tobacco stick by the filter portion. Thus, the user is likely to hold the device on or around the area being heated.

The reality of this form factor creates a conflict. The tobacco stick must be adequately heated to release nicotine, vapor agents (e.g. vegetable glycerin, propylene glycol, etc.) and flavors, but the outside of the device must be cool enough to hold. To this conflict, there is a third dynamic, namely, the issue of heater performance and energy use. Heat requirements for heat not burn devices are relatively high, there are issues of start up times until operating temperatures are reached, and consumers frequently want a battery that will allow for multiple tobacco stick "smoking" or "vaping" sessions prior to re-charging.

In addition to these technical challenges, there is an additional important consideration, namely public health concerns. Specifically, there is increasing concern about traditional e-cigarettes (i.e. liquid based as opposed to tobacco sticks) and youth adoption of e-cigarettes. These is a likely benefit of tobacco stick based devices insofar as they may appeal more specifically to existing smokers, the desired demographic. However, the costs of tobacco stick device like IQOS® and GLO® are out of reach for many consumers, particularly so in certain markets where cigarettes remain inexpensive. For example, in a country like Argentina, a pack of cigarettes retails for around one dollar, making a sixty-dollar device a hard sell for many smokers who need alternatives to combustible cigarettes.

It is an aim of certain embodiments of the present invention to provide for an effective heat not burn device that is faster to manufacture, and less expensive to manufacture, than existing devices.

The present invention teaches a heat exchanger that both serves to adequately cool the device, using outside, ambient air, and pre-heats air prior its entry into the heating tunnel where the tobacco stick is heated and aerosolizable components are vaporized.

It is an object of the present invention to provide for, in certain embodiments, a device comprising a heat exchanger and cylindrical heating of the tobacco stick.

It is an object of the present invention to provide for, in certain embodiments, a device comprising a heat exchanger, a non-cylindrical heating system wherein said heating system does not penetrate the tobacco substrate component of the tobacco stick.

It is an object of certain embodiments of the present invention to provide for a device with a heat exchanger, cylindrical heating (or non-cylindrical non-penetrative hearting), and the optional inclusion or exclusion or a heat blade or other shaped penetrative heater that is inserted in the tobacco component of the stick.

It is an object of the present invention to allow for a relatively compact heat not burn device (i.e. a relatively short distance between the tobacco stick and the outside of the case) that does not require or comprise a vacuum chamber to reduce heat transfer to the outside casing.

It is an object of certain embodiments of the present invention to allow for device capable of heating a standard cigarette-diameter tobacco stick (i.e. in the range 7.5 mm to 8.5 mm) using only cylindrical heating (and not a penetrative heater that is inserted into the tobacco component of the stick).

It is an object of certain embodiments of the present invention to reduce or minimize the effect of differences in ambient temperature (i.e. varying ambient temperatures) on vapor production, vapor composition (including nicotine per puff and harmful or potentially harmful constituents) and quality of the device. Differences may be considered by measuring total emissions from a stick, or on a per puff basis. This is achieved through the use of the heat exchanger.

It is an object of certain embodiments of the present invention to enable uniform vaporization of the tobacco portion of a tobacco stick. By uniform vaporization, the "used" tobacco is more consistent in terms of moisture content, residual nicotine, and/or lack of pyrolysis.

It is an object of certain embodiments of the present invention that the tobacco of the tobacco stick, after it is used, assays for residual nicotine such that samples from different geographic parts of the used tobacco stick are within 25%, preferably within 15%, more preferably within 10%.

It is an object of certain embodiments of the present invention that the tobacco of the tobacco stick, after it is used, assays for vapor agent (e.g. vegetable glycerin, or propylene glycol) such that samples from different geographic parts of the used tobacco stick are within 25%, preferably within 15%, more preferably within 10%.

It is an object of certain embodiments of the present invention that the tobacco of the tobacco stick, after it is used, assays for water content such that samples from different geographic parts of the used tobacco stick are within 25%, preferably within 15%, more preferably within 10%.

It is an object of certain embodiments of the present invention to enable the vaporization of a tobacco stick without melting (or substantially without melting) the polymer film filter of the tobacco stick, including without limitation where the polymer film comprises polyactide.

It is an object of certain embodiments of the present invention to minimize cooling effect per puff, meaning the drop in temperature caused by the introduction of air into the tunnel when the user puffs.

It is an object of certain embodiments of the present invention to have a heating effect per puff, as heat is drawn from the heat exchanger and into the tobacco stick, despite the absence or substantial absence of a combustion-based, exothermic reaction.

It is an object of certain embodiments of the present invention to reduce or eliminate cleaning needs for the device. Reducing or eliminating pyrolysis will lead to less or no residue in the tunnel.

It is an object of certain embodiments of the present invention to allow for the use tobacco sticks where the tobacco sticks do not comprise a metallic foil heat reflector.

It is an object of certain embodiments the current invention to minimize temperature that effects the user while holding the device, yet efficiently operate at adequate operating temperatures.

It is an object of certain embodiments of the present invention to maintain an outer temperature of the heat exchanger, during use, of 35°–100° C., preferably 60° to 85° C., more preferably, 60° to 80°, most preferably 75°–80° C.

It is an object of certain embodiments to provide for a heat exchanger within an outer case, where during use, the outside temperature of the case does not exceed 50° C., preferably does not exceed 45° C., more preferably does not exceed 40° C.

It is an object of certain embodiments of the current invention to maximize the temperature differential between the internal tobacco substrate and the outside of the vaporization device.

It is an object of certain embodiments of the current invention to function with tobacco sticks wherein the tobacco substrate is cut rag akin to a conventional cigarette as opposed to a substrate-based tobacco plug.

It is an object of certain embodiments of the present invention to achieve an improved air intake system, which both cools the device for acceptable outer temperatures for the user holding the operating device, and pre-heats this same air effectively prior to delivering the air into the tobacco stick tunnel and the tobacco stick.

The invention relates to smoking or vaping articles, in particular to heaters intended for use as part of an electronic vaporizer device for vaping of cigarettes or vapable tobacco sticks without or substantially without pyrolysis (burning, smoldering) and can be used as part of portable and stationary electronic devices for heating of tobacco sticks.

A heater for vaporizer with air preheating element, optionally includes, in certain embodiments, a casing, a tunnel (optionally) with a perforated bottom, which is a cylindrical heating chamber for placing a cigarette, a heating element of resistive type, a heat exchanger, including air channels for circulation and preheating of air by the heater, top and bottom ends, air intake hole made in the top end, an air intake made in the bottom end, outlet holes communicated with exits of air channels of the heat exchanger for delivery of air preheated by the heater into the tunnel.

In certain embodiments, the exits of air channels of the heat exchanger enter into the lower portion of the tunnel (as opposed to the bottom).

In certain embodiments of the invention, the tunnel is made in the form of a tape (or ribbon) of a thin-film heat-resistant material, upon which a thin layer of resistive material with contacts is applied on the end of one side, forming a heating element, and towards the other end of the same side, top and bottom spacers are fixed and inclined toward the middle, as well as the edging, which are made of flexible, optionally heat-resistant material. By "inclined toward the middle" we mean that the spacers that form the air ducts have a v-shaped presentation, as shown in FIG. 4. Other shapes may be employed as spacers.

In certain embodiments, the heat element may be placed on the opposite side of the spacers and edging, such that when assembled the heating element is on the inside of the tunnel. In certain embodiments, there are heating elements on both sides of the thin film material, such that when assembled there is a heating element on the inside of the tunnel, and a heating element on the outside of the tunnel.

Optionally the thin film heat-resistant material is dielectric. Optionally, the heat exchanger and/or thin film material comprises aerogel.

The resistive material used to form the heating element on the tape may be deposited or printed using any known method, including inter alia 3*d* printing.

The spacers may be deposited or printed on the tape using any known method, including inter alia 3*d* printing.

Any known heat resistant material may be substituted for the thin film dielectric heat-resistant material. In other embodiments, non heat resistant material may be used as the thin film material.

In certain embodiments, the tape is not a consistent material, but rather represents one or more materials with varying properties. The tape may also optionally vary in thickness. It may vary in heat resistance. It may constitute an amalgamation of different materials, concentrated in different geographic domains or locations.

Certain embodiments will reduce measurable temperatures at different geographic zones in the tobacco portion of the tobacco stick to a temperature band of +/−25%, preferably +/−15%, more preferably +/−10%. Said temperatures are measured after the completion of the warm up cycle. Alternatively, such temperatures may be measured during a puff. Such puff measurements may be made using any known smoke testing regime, i.e. ISO standard, HCl Standard, Massachusetts Average, Canadian Intense, and the low airflow rate 2 second and low airflow rate 4 second protocols described here: https://escholarship.org/content/qt32x2z2z5/qt32x2z2z5_noSplash_9951cbbd575bddea177adfa64ca2a1a7.pdf In certain embodiments, the heat exchanger is formed around a existing tunnel blank that remains in the heat exchanger after the heat exchanger is formed. This tunnel blank may serve two potential purposes: first, the create a structure around which the heat exchanger is formed; second, to provide a structure that resists deformation during extended periods of device use. Generally, though not necessarily, the tunnel blank is shorter than the length of the formed tunnel. This difference in length is necessary for the heater to have direct contact or access to the tobacco stick—and not being positioned on the outside of the tunnel blank. Any heat resistant material may be employed for the tunnel blank, including plastics, metals and other materials. Steel, and in particular stainless steel, are preferred materials for the tunnel blank.

In certain embodiments, the tunnel has a volume of 812 $mm^3$, and the heat exchanger has a volume of 3572 $mm^3$. The tunnel volume may range from 500 $mm^3$ to 1000 $mm^3$ for tobacco sticks, preferably 750 $mm^3$ to 850 $mm^3$. Larger volumes, i.e. tunnel volumes greater than 1000 $mm^3$ are contemplated for loose tobacco, herbal and marijuana uses.

In most embodiments, the heat exchanger volume (the volume of interconnected air flow channels therein) will be from 300% to 600% percent larger than the volume of the tunnel, preferably 350% to 550% larger volume, and most preferably 400% to 500% larger than the volume of the tunnel.

In certain embodiments, the heat exchanger has a volume of 2500 to 6000 $mm^3$, preferably 2750 to 4750 $mm^3$, most preferably 3000 to 4000 $mm^3$.

In certain embodiments, the invention is made in a continuous, or semi-continuous manufacturing process, wherein, the tape material is the starting material, all or some of the heating element, the spacers and the edging are applied to the tape, the tape is rolled as described herein to form the tunnel and heat exchanger, the tunnel and heat exchanger are then placed in any final outer casing. The outer casing may be for a portable device or a stationary device. Typically, in semi continuous manufacturing, the tunnel and heater exchanger are formed in one step, and the tunnel and heat exchanger are placed in the casing as part of an additional step.

The rolling method of manufacture of tunnel and heat exchanger may be applied to the various embodiments and permutations of the invention described herein.

A non-cylindrical tunnel is expressly contemplated, in which case the rolling method may still be performed, by rolling the material around a non-cylindrical blank. Such a design can accommodate a non-cylindrical tobacco stick. This may be particularly useful to employ a unique tobacco stick design (i.e. a non-cylindrical tobacco stick) to prevent or discourage the use of generic tobacco sticks with the novel device. A non-cylindrical tunnel may also be useful with loose vaporizable material, for example and without limitation, marijuana, loose tobacco, and other herbs.

The tunnel and heat exchanger with labyrinth circulation after manufacture by rolling (or other suitable method), may be placed in a pre-formed outer casing or shell.

The tunnel may be extended lengthwise to accommodate a battery below the seat where the tobacco stick will rest. A wider tape may be employed to make such embodiments.

Generally, the shape of the tunnel is a conventional cylinder. However, in certain embodiments, the tunnel walls may have an outward slope (i.e. an angle of greater than 90 decrees from the bottom plane) to snugly fit the tobacco stick, and yet allow for easier insertion. The tunnel wall may slope from 90 to 95 degrees from the plane of the bottom of the tunnel. In certain embodiments, a non conventional cylinder is employed where only a portion of the tunnel wall slopes outward. Optionally, such embodiments may be made by wrapping the tape around an otherwise pre-formed tunnel.

While the heating element will generally be oriented on the outside of the tunnel, in certain embodiments, the heating element may be oriented on the inside of the tunnel, or, in still other embodiments, a heating element is placed on both sides of the tape such that the resulting tunnel has a heating element on both sides of the tunnel. Moreover, still other embodiments will have one or more heating elements in the heat exchanger itself.

In certain embodiments, the top spiral air duct inlet is communicated with the inlet hole located on the top end, and its outlet is communicated with the inlet of the middle spiral air duct. The inlet of the bottom spiral air duct is communicated with the inlet hole located on the bottom end, and its outlet is communicated with the inlet of the middle spiral air duct. The outlet of the middle spiral duct is in contact with the heater area and communicates with the outlet holes for the intake of air preheated by the heater into the tunnel.

One technical problem solved by the invention is to simplify the design of the heater and the assembly of its components. The result, is an increased manufacturability of the claimed heater for a vaporizer of electronic devices for heating vapable tobacco sticks with air preheating, improved thermal insulation properties and greater heating efficiency which improves the vaporization performance of the device.

In certain embodiments, the heat exchanger system of the present invention substantially reduces or eliminates the need for insulation materials, or a vacuum zone or zones for insulation properties, between the casing and any outer housing. The vacuum zone or zones may be absent from the device itself, including absent from the heat exchanger.

Where an outer housing is employed, the air inlets in the casing mate to air inlets, in corresponding geographic location, to the air inlets in the casing.

In certain embodiments, the heat exchanger is in direct contact with the outer housing, without the need for space between the outer housing and casing.

In primary embodiments, the ducts of the heat exchanger will be empty. However, in certain embodiments, the ducts may be filled with one or more materials selected for insulation purposes, or to modify airflow rates and/or air pressure under draw (inhalation) by the user. Optionally, such materials are deposited or printed onto the material that is rolled to form the tunnel and heat exchanger.

In certain embodiments, the inlet hole(s) may further comprise valves. Additionally, one or more valves may be employed in the ducts of the heat exchanger. Such valves may serve various purposes including to allow heat to increase in the heat exchanger when not under draw. Generally, the valves are actuated by pressure but the valves may be actuated by the device itself, i.e. non pressure actuation.

In certain embodiments, the device may comprise a water or moisture reservoir system, wherein moisture is available to increase the humidity of air passing through the heat exchanger, or air in the tunnel.

Said technical problem is solved, and the technical result is achieved due to the fact that in the vaporizer heater of electronic devices for heating vapable tobacco sticks with air preheating element. Such an improvement of the heater due to the use of a spiral tape made from thin-film dielectric heat-resistant material ensures easy forming and efficient configuration of the main components of the heater, including the heating element, the tunnel and the spiral casing, which may be an Archimedean spiral in plan. The inventors specifically contemplate alternative airflow designs (i.e. non-Archimediean spiral) for the heat exchanger.

In certain embodiments, the air flows upwards from an inlet channel or channels at the bottom of the device, and then flows downwards through the Archimedian spiral. The air in the spiral warms as it passes downwards. The air from the spiral is then concentrated in the tobacco plug area as the user inhales and takes a puff. This concentration of warm air is markedly distinct from the IQOS® device architecture, in which a puff actually cools the air in the tobacco plug when the user takes a puff. The concentration of warm air from the Archimedian spiral contrasts with the known phenomenon of puff cooling in IQOS®. The puff-driven cooling of IQOS® is evident from its architecture, and is discussed in the New Zealand Ministry of Health Report 17/11019 dated 17 Nov. 2017 and available here (and incorporated by reference as if fully set-forth herein): https://www.pmiscience.com/resources/docs/default-source/NCDC-vs-Morris/nz_crl-energy-ltd---investigation-into-iqos-device-heets-tobacco-sticks-and-evidence-of-combustion november-2017.pdf. The heat exchanger is, in certain embodiments, akin to snail design.

The present invention allows for more consistent flavor profile, and greater puff-to-puff consistency. Improved puff-to-puff consistency extends to nicotine delivery per puff, as well as mass evaporation per puff. As demonstrated in the Examples below, mass evaporation per puff is higher while employing a lower temperature than the IQOS 3 device, using an embodiment of the current invention.

The present invention further may allow for more consistent nicotine delivery and per puff mass evaporation in different temperature conditions.

The significance and benefit of eliminating (or substantially reducing) per puff cooling is this: per puff cooling dynamic requires a higher heater temperature to account for such cooling. Higher temperature is associated with incidental combustion and otherwise with increased production of HPHC's. Embodiments of the current invention, such as the Archimedian spiral, help to obviate per puff cooling of the tobacco plug. As discussed below, forsage with the heater(s) may be employed in various embodiments to compensate for a puff-driven cooling dynamic.

As a result of using top and bottom air inlets, top and bottom spacers inclined towards to the middle, as well as the use of edging (by "edging" we mean the spacer around the perimeter, i.e. item 13 in the drawing), the forming of a spiral heat exchanger and top, bottom and middle spiral air ducts for spiral and labyrinth circulation and effective preheating of air are simplified. In this case, the top and bottom spiral air ducts in the spiral heat exchanger communicated with the inlet holes in the top and bottom ends, ensure the optimal formation of two spiral air flows, which are converted into one converging spiral air flow when entering the middle spiral air duct. In most embodiments, the two spiral air flows will go in opposite directions, i.e. one down from the top, and the other up from the bottom. In other embodiments, a single spiral air flow may be employed. As discussed herein, the airflow may optionally be non-spiral in the heat exchanger.

Such a spiral heat exchanger, in which the flow of air during the circulation process can cool the structural elements along which it moves, helps to avoid the use of additional thermal insulation of the heater or minimize its use in the end product, and may otherwise reduce the external temperature of the of the device, including where held by the user. Having reached the area where the heater is installed, the air is heated by the heat of the heater, then it flows through the outlet holes into the tunnel, thus making the heater design less complicated and the process of air preheating in it more efficient. This allows to significantly increase the manufacturability of the provided improved heater for vaporizer device with air preheating.

In certain embodiments, the spiral heat exchanger may itself comprise one or more heating elements.

In certain embodiments of the invention, the spiral coils of the tape in the heater are glued together by an adhesive substance applied to the top and bottom spacers and the edging, where an adhesive substance is Dow Corning 736 silicone heat-resistant sealant glue or an equivalent thereof, or other heat resistant sealant glue or adhesion techniques. This ensures a simple, easy-to-manufacture connection of the spiral coils of the tape, which forms the heat and the heater casing.

As the resistive material of the heating element in the heater, certain embodiments employ a high-resistivity metal selected from among nichrome or FeCrAl alloy, or low-resistivity metal selected from among stainless steel, nickel or titanium. The use of these metals as a resistive material for the heating element provides efficient heating of air in the heater. These example materials are non-limitative.

In certain embodiments, a seat is provided at the bottom of the heater tunnel, with wall holes and top axial hole for the intake of preheated air into the tunnel. The installation of such a seat in the tunnel creates, firstly, a reliable support for the tobacco stick in the heater, and, secondly, may provide the supply of preheated air from the heat exchanger to the tobacco stick in the tunnel through the wall and axial holes.

It is an object of the present invention to provide for more efficient, and/or more rapid heating than other heating systems for tobacco sticks. Improved, more rapid heating may result in a reduced duration warm up cycle.

By efficiency, we mean the power used from the battery relative to the delivery of adequate heating (or a given heating temperature) via convection and/or conduction to the tobacco stick.

Certain embodiments of the present invention may combine the improved convection heating of the present invention together with conductive heat systems that penetrate the tobacco substrate (i.e. where the device contains a heater in direct contact with the tobacco substrate), or conductive systems that are in contact with the tipping paper (outer wrapping of the tobacco stick). In such embodiments, the device will have two separate heating systems that act in concert, or an integrated heating system comprising both a penetrative and non-penetrative feature. In such embodiments, the combination of the conductive and convective heat system of the present invention, together with a penetrative conductive heating system, will result in more consistent heating across the width and/or length of the tobacco substrate in the tobacco stick as compared with a conventional, penetrative heating elements.

Typically, embodiments will merely employ a circumferential heating element, i.e. one around the circumference of the tunnel that receives the tobacco stick, located on the inside of the tunnel (i.e. in contact with the tobacco stick), optionally on the outside of the tunnel, or both.

It is noted that the improve temperature dynamics of the heat exchanger are complementary even the use of a penetrative heating element.

It is an object of the present invention to improve performance of a hybrid system (convection and conductive heating system) in terms of speed (time) to operating temperature (minimizing warm up time), and total energy use for a given use cycle.

It is an object of the present invention to maximize the nicotine that is vaporized from a tobacco stick, when the tobacco stick heated within a predetermined heating range.

It is an object of the present invention to maximize the non-nicotine volatiles that are vaporized from a tobacco stick, when the tobacco stick is heated within a predetermined heating range.

It is an object of the present invention to maximize mass loss of a tobacco stick after use for a given operating temperature range.

While the primary use for embodiments of the current invention relates to tobacco sticks, it is expressly contemplated that the invention may be used with non-tobacco materials, including without limitation non-tobacco botanicals, marijuana including marijuana concentrates and derivatives, and synthetic materials appropriate for vaporization including inter alia synthetic nicotine.

It is further contemplated that embodiments of the current invention may be employed, with suitable adaptation, for use with non-tobacco stick tobacco materials, tobacco leaf, tobacco waxes, tobacco oils, e-liquids, and other materials suitable for vaporization.

Embodiments of the current invention may be adapted to vaporize loose material, or material contained in cartridge, pod, or other vessel.

It is an object of the present invention to reduce the variability of temperature of the tobacco substrate when heated when measured at different geometric locations within the tobacco substrate, through improved convection heating.

It is an object of the present invention to reduce the conductive heat required with a tobacco stick. Lower conductive temperatures reduce the charring of tipping paper where the conductive heating element is in contact with the tipping paper, and also reduce "charring" of tobacco substrate.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
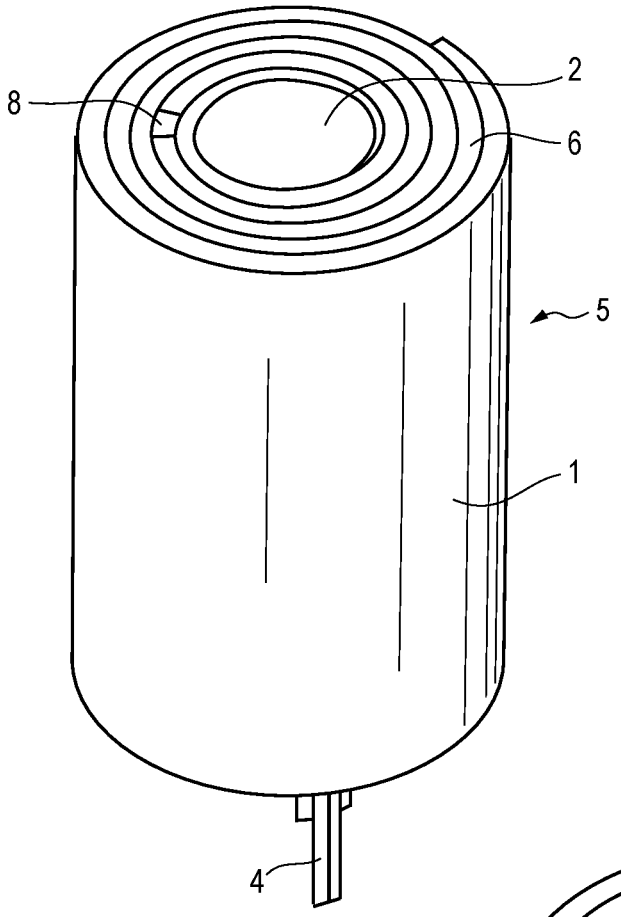
FIG. 1 illustrates a top and side perspective view of a heat exchanger for a vaporizer device with an air preheating element.
Figure 2:
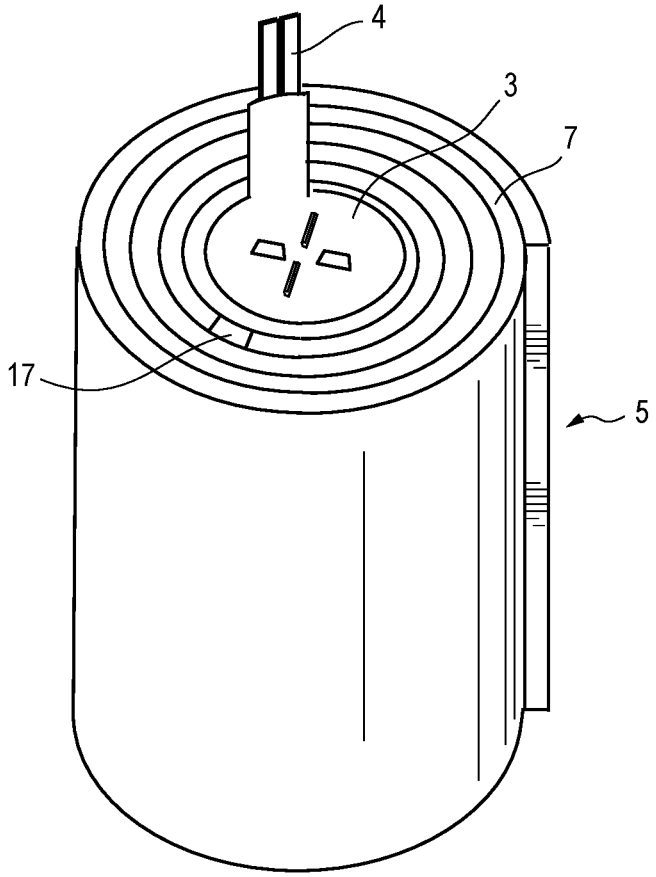
FIG. 2 illustrates a bottom and side perspective view of the heat exchanger for the vaporizer device with the air preheating element.

The heat exchanger of the present invention is, in certain embodiments, a cylinder in which a tobacco stick is inserted. The resistance heater is applied to a cylinder made of optionally thin heat resistant material. Around the cylinder is a multi-channel or single channel duct through which air flows when the user takes a puff. Before the air enters the inside of the tobacco stick, it travels one or more, or several turns through the air channels. This minimizes the transfer of heat to the outer structure, and at the same times heats up the air along its route.

The air in the heat exchanger may travel more than 3 turns, preferably more than 5 terms, more preferably more than 8 turns, still more preferably more than 10 turns.

Referring to FIGS. 1-8, a heater 5 for vaporizer device with air preheating element comprises a the outer portion of the heat exchanger 1, a tunnel 2 with an optionally perforated bottom 3, which is a cylinder-shaped cigarette heating chamber, a heating element (air heater) 4 of resistive type, a heat exchanger 1 comprising the air channels for air circulation and preheating by the air heater 4, a top end 6 and a bottom end 7, an inlet hole 8, made in the top end 6 for air intake, an inlet hole 17, made in the bottom end 7 for air intake, an outlet holes 9 (see FIGS. 5, 6 and 8) communicating with heat exchanger air flow channel 16 for the intake of air preheated by the air heater into the tunnel 2.

Figure 5:
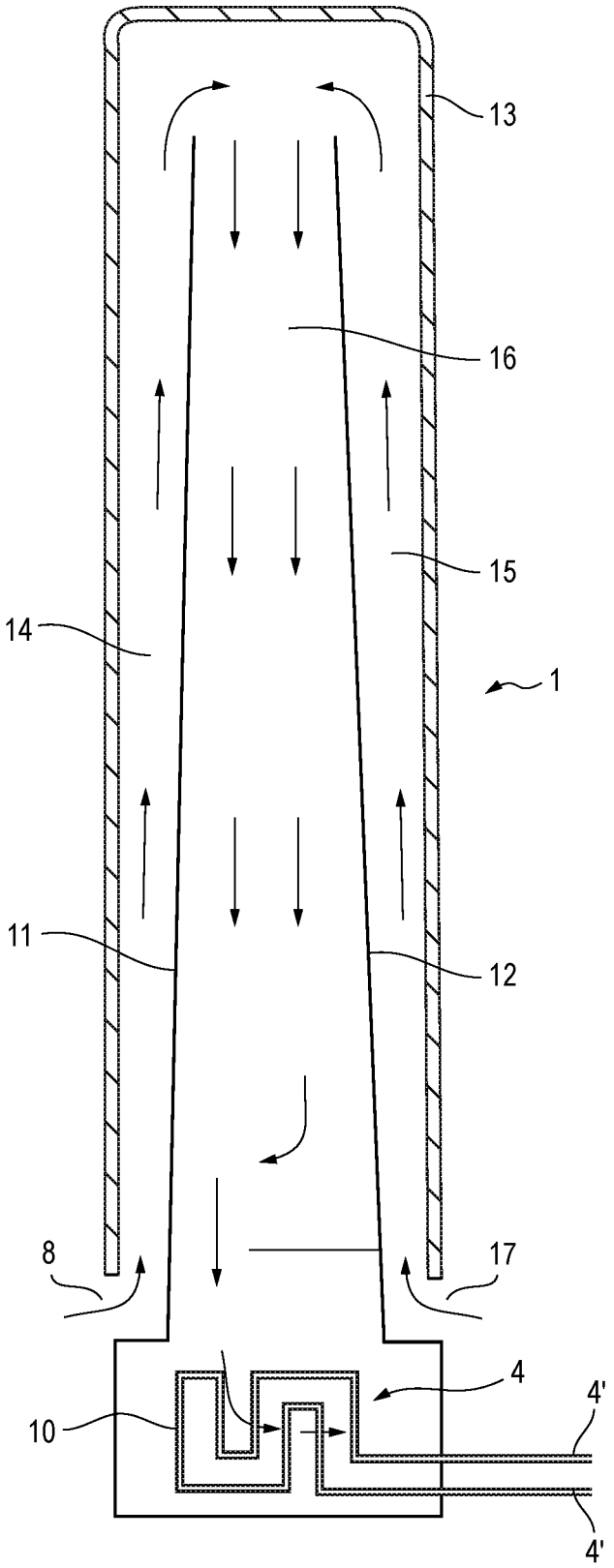
FIG. 5 illustrates a conceptual view showing airflow in the heat exchanger for the vaporizer device with the air preheating element, made in the form of a tape of a thin-film dielectric heat-resistant material.

As seen in FIG. 5, the heat exchanger 1 is made from of a tape from a thin-film dielectric heat-resistant material, where heater 4 in the form, e.g., of a thin layer of resistive material 10 with contacts 4' is applied on one end, forming the heating element 4 and the top 11 and bottom 12 spacers inclined towards the middle, as well as an edging 13, which are made of flexible heat-resistant material, are fixed on the other end. For simplicity, the outlet holes 9 are not shown in FIG. 5. The tape or thin material used to make the heat exchanger can also be see in partially-rolled form in FIGS. 9, 10 and 11 and in alternative format in FIG. 13.

Figure 13:
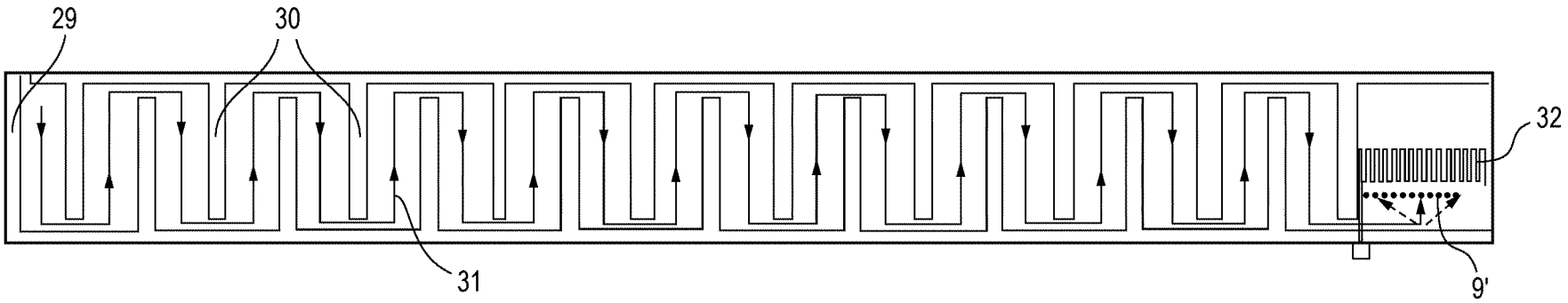
FIG. 13 illustrates a heat resistant tape, with spacers and heating element, designed to form a non-spiral heat exchanger.
Figure 18:
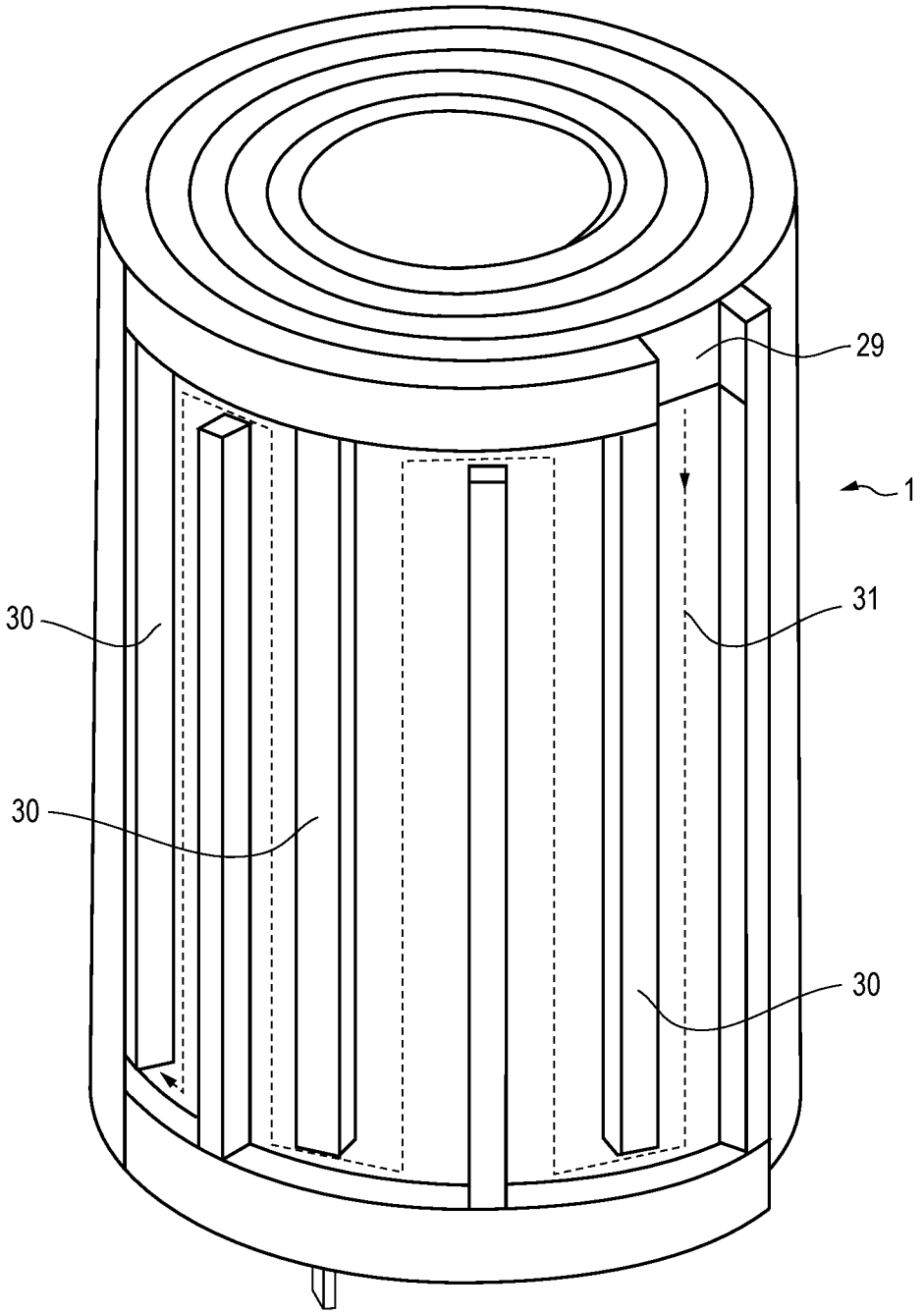
FIG. 18 represents an assembled heat exchanger with non-spiral airflow. The heat exchanger of FIG. 18 may be assembled with tape akin to that shown in FIG. 13.

FIG. 13 represents a tape that will form a non-spiral air flow pattern, but rather a series of multiple up and down turns. The non-spiral heat exchanger is seen in FIG. 18.

Returning to a spiral heat exchanger, the said tape with the heating element 4 located on its outer side is rolled into a cylinder and forms the tunnel 2 and additionally coiled into several inter connected spiral coils, and forms a spiral casing 1 with top and bottom ends 6, 7 so that the top 11 and bottom 12 spacers located on the inner side and the edging 13 form the spiral heat exchanger 5. See FIGS. 9-11 and FIG. 13, and the cut-away heat exchanger shown in FIGS. 6 and 7.

The heat exchanger 5 comprises the top 14, bottom 15 and middle 16 spiral air ducts for spiral and labyrinth circulation and preheating of air. At the bottom end 7, an additional inlet 17 for air intake is made. The top spiral air duct inlet 14 is communicated with the inlet hole 8 located on the top end 6, and its outlet is communicated with the inlet of the middle spiral air duct 16.

The inlet of the bottom spiral air duct 15 is communicated with the inlet hole 17 located on the bottom end, and its outlet is communicated with the inlet of the middle spiral air duct 16. The outlet of the middle spiral duct 16 is in contact with the heater 4 area and communicates with the outlet holes 9 for the intake of air preheated by the heater 4 into the tunnel 2.

The additional distinctions of the provided heater are the following improvements in its design. The spiral coils of the tape are glued together by an adhesive substance applied to the top 11 and bottom 12 spacers (11,12) and the edging 13, where an adhesive substance by way of example only is Dow Corning 736 silicone heat-resistant sealant glue or an equivalent thereof.

Figure 6:
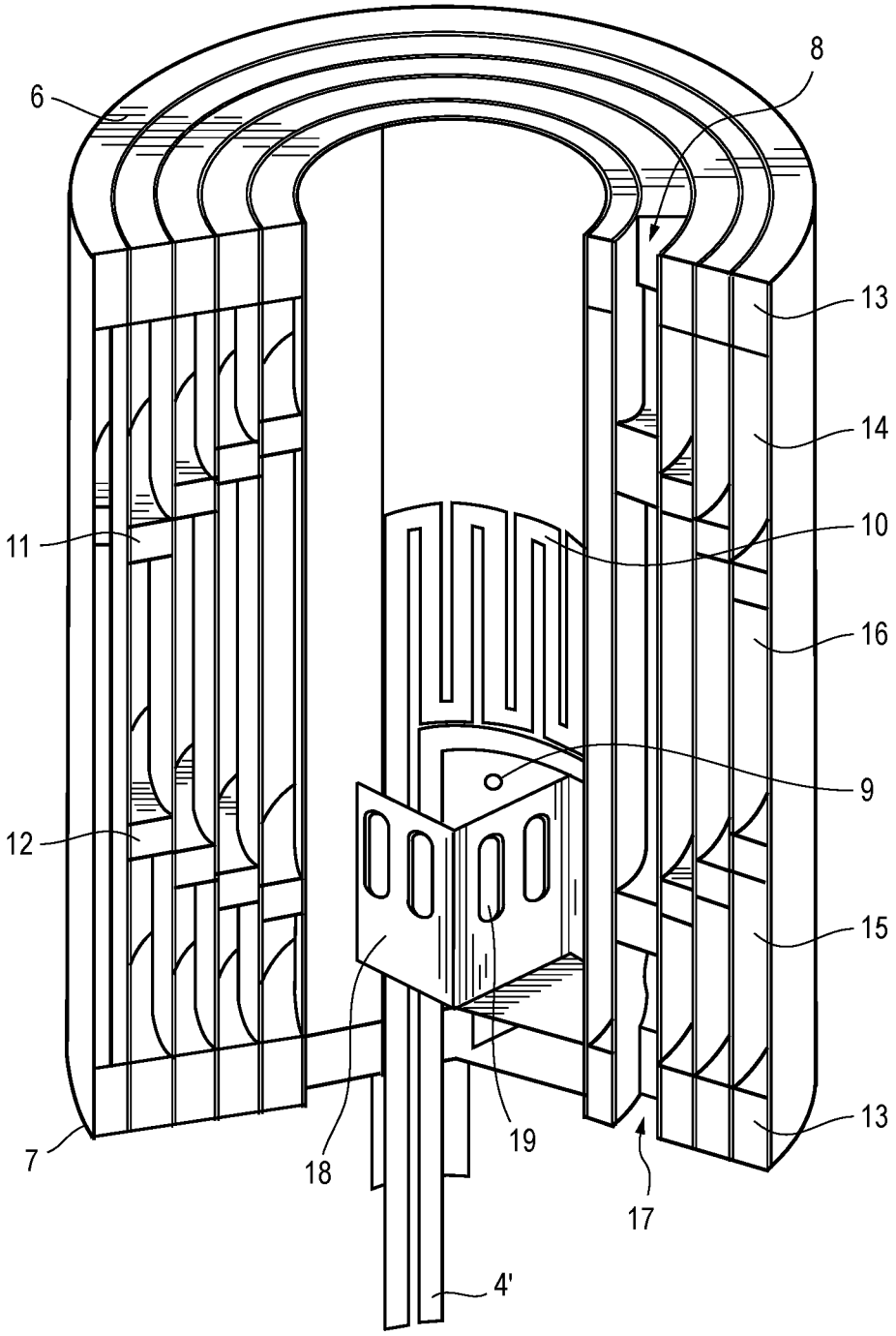
FIG. 6 illustrates a cross sectional view of the heater for the vaporizer device with the air preheating element.
Figure 7:
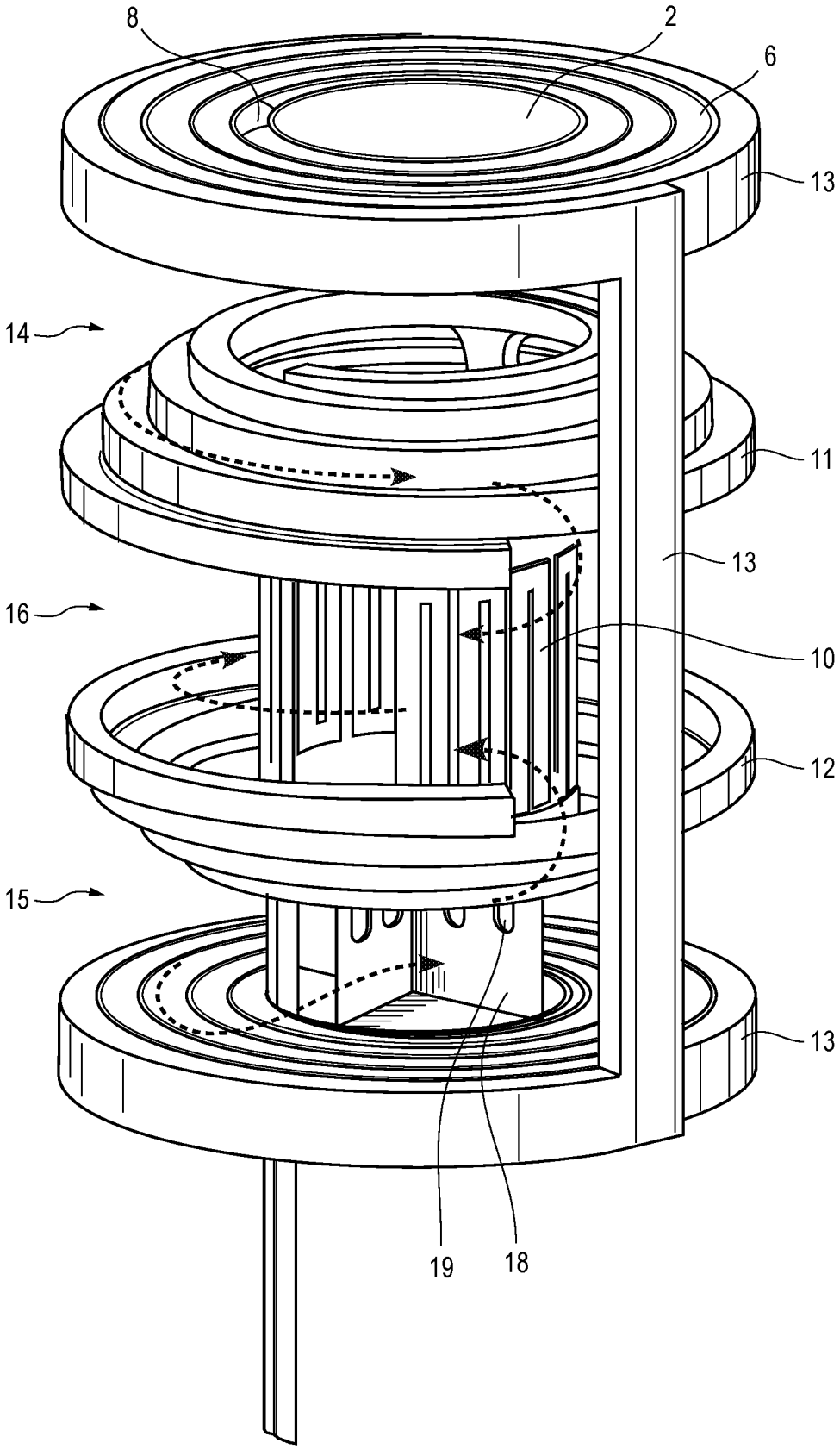
FIG. 7 illustrates the heater for the vaporizer device with the air preheating element of a transparent casing tape and a diagram of transition of top and bottom spiral air channels into the middle spiral air channel of the heat exchanger.

As the resistive material 10 of the heating element 4, we have used a high-resistivity metal selected from among nichrome or FeCrAl alloy, or low-resistivity metal selected from among stainless steel, nickel or titanium. As best seen in FIG. 6, a seat 18 is provided at the bottom 3 of the tunnel 2, with wall holes 19 and top axial hole for the intake of air preheated by heater 4 into the tunnel 2. The provided heater for a vaporizer device with air preheating is used as part of portable or stationary electronic device designed to heat and vaporize cigarettes or tobacco sticks 24 (FIG. 8), which may comprise a heater with a cigarette and a heating element 4 (temperature sensor), an electronic adjustment and control module 21, a power supply 22 and a heating activation sensor button 23. The heating element 4 can simultaneously be both a heater and a temperature sensor. When heating or cooling, resistive material 10 of heating element 4 changes its resistance, and these properties can be used as a temperature sensor.

The electronic adjustment and control module 21 is optionally intended for the generation of pulse-width modulation (PWM) voltage for powering the heater, adjusting the PWM parameters, processing the feedback signal from the heater temperature sensor, switching the heater power supply voltage, processing the signal from the activation sensor. The power supply 22 provides electrical power to the device. In the portable version of the device, the power supply may be a lithium-ion, lithium-polymer, lithium-iron-phosphate, nickel-cadmium storage cells or a storage battery made up of cells of this type, or other known power sources, including inter alia electrical sources and combustion-based heating systems.

In the stationary version of the device, the power supply may be a power source connected to AC mains. The heating activation sensor 23 is intended to start the heating process. A button located on the casing of the device in a place convenient for the user can be used as a manual heating activation sensor 23. The temperature sensor of the heater 4 is designed to monitor the temperature of the heater 4, which can be used either separately or as several elements placed directly in the heating area. The function of the heater temperature sensor can be performed by the resistive-type heating element 4 itself.

Multiple temperature sensors may be employed, particularly in embodiments with multiple heaters.

The provided heater for a vaporizer with air preheating is used as part of a portable or stationary electronic device intended for heating and vaporizing cigarettes or tobacco sticks as follows. For a vaping session, the user places a cigarette or tobacco stick 24 in the chamber 2 of the heater. Further, the user presses the heating activation sensor button 23. The signal from the button 23 is received by the electronic adjustment and control module 21. In the electronic adjustment and control module, the PWM generator starts generating pulses of a certain frequency and duration. Further, the pulses are received by the key power element, which switches the application of supply voltage to the heating element 4. The heating element 4 begins to heat up. The user inhales. The air enters the holes 8 and 17 located on the top and bottom ends 6 and 7, respectively. Further, the air follows through channels 14 and 15 and enters the middle channel 16.

Further, the air follows the channel 16 and enters the heat exchanger, where the heating element 4 is located. Further, the air through the holes 9 enters the space formed between the tobacco stick 24 installed in the tunnel 2 and the bottom of the tunnel 3. Further, the heated air follows through the holes of the seat 18 and enters the substrate of the cigarette 24. Passing through the heated substrate, the air is enriched with the active substance (and other substances) evaporating from the substrate. Further, the enriched air flows through the tobacco stick filter and into the user's mouth. To maintain the set temperature of the heater, a temperature sensor is used—the heating element 4, the signal from which comes to the electronic adjustment and control module.

Figure 9:
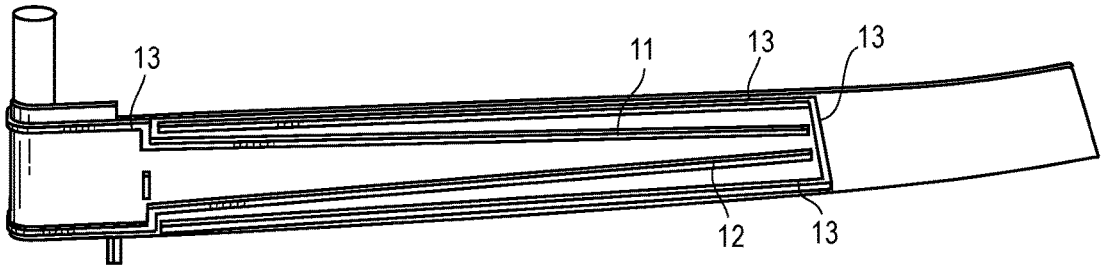
FIG. 9 illustrates a heat resistant tape with edges and spacers being suitable for rolling into a heat exchanger.
Figure 10:
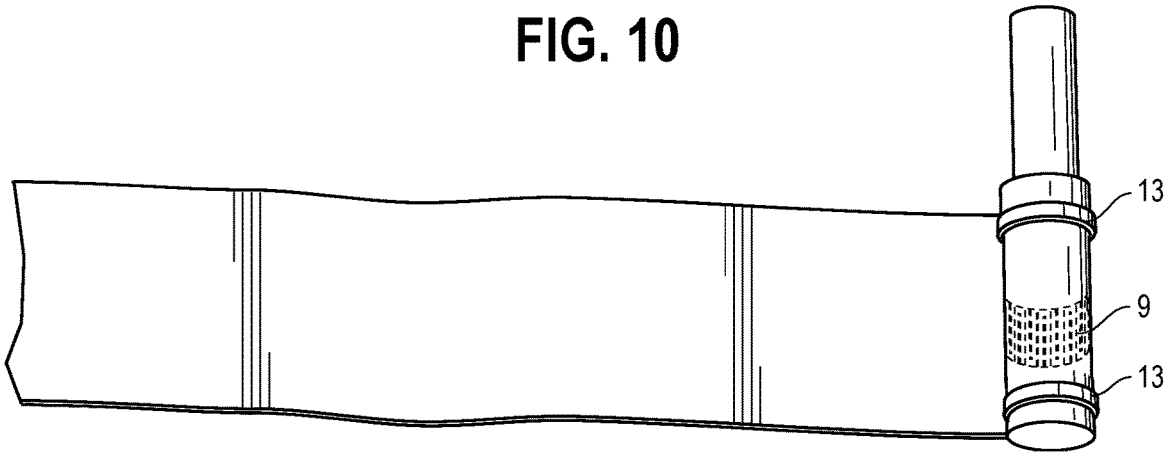
FIG. 10 illustrates the heat resistant tape where the heat exchanger is being rolled as well as spacers.
Figure 11:
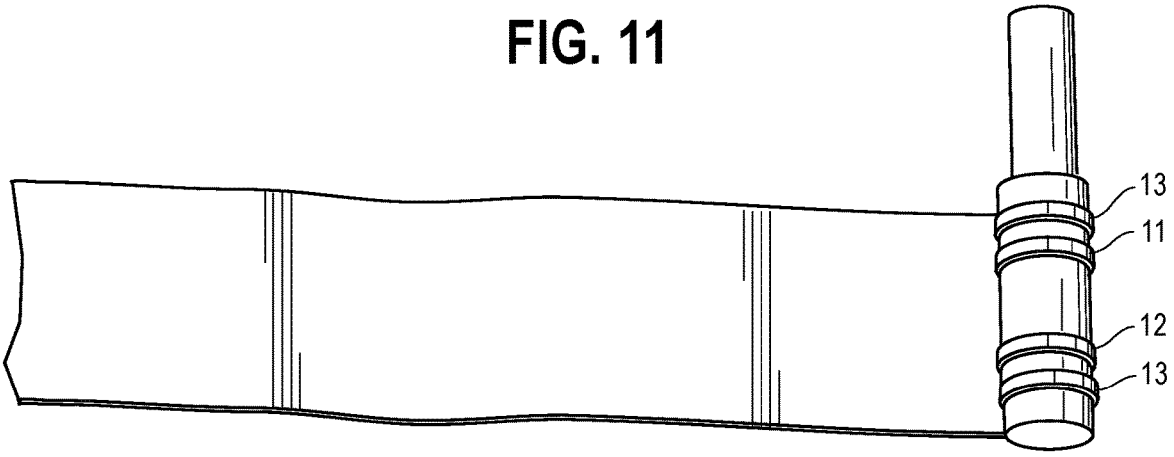
FIG. 11 illustrates the heat resistant tape being further rolled with formation of additional spacers on the rolled heat exchanger.

FIG. 9 shows the outside of the tape from which the heat exchanger is made at the start of the rolling process, showing the edging 13 and spacers 11 and 12, FIG. 10 shows the rolling as it progresses from that of FIG. 9 with the edging 13 and holes 9. FIG. 11 shows the rolling as it progresses from that of FIG. 10 with further rolling of the edges 13 and spacers 11 and 12.

Figure 12:
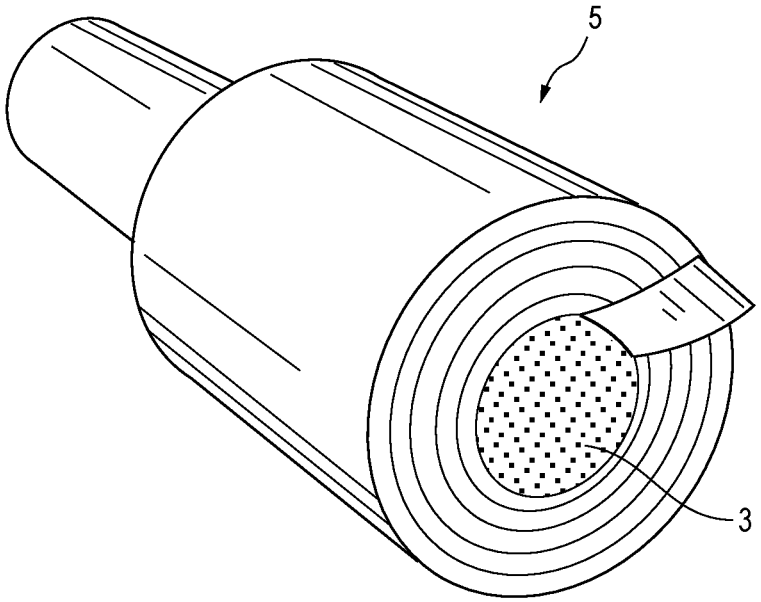
FIG. 12 illustrates a bottom developed view of the heater casing for the vaporizer device with the air preheating element, made in the form of a tape of a thin-film dielectric heat-resistant material.

FIG. 12 is a bottom perspective of the heat exchanger 5, with a perforated bottom 3 of the tunnel 2.

FIG. 13 is an unrolled tape used to form a mono-channel heat exchanger with septa (discussed in Example C.) in which 29 is the inlet hole, 30 are septa, and 31 is the airflow, 32 is the heater, which may be combined with a penetrative heater, and 9' are the outlet holes.

Figure 14:
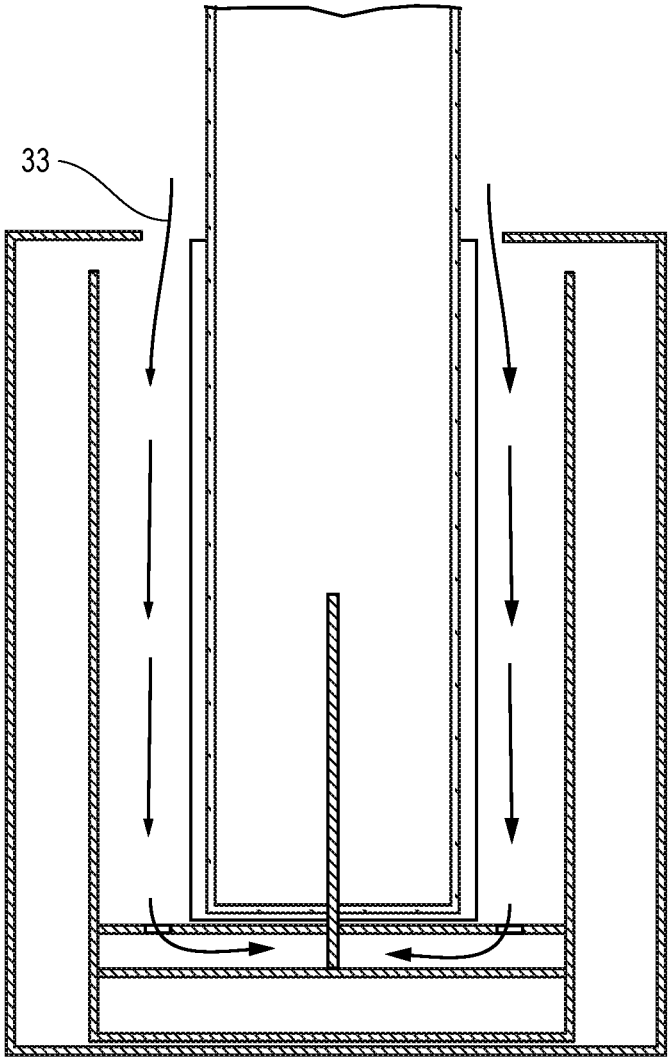
FIG. 14 illustrates the airflow in the in the Philip Morris International IQOS 3 device.

FIG. 14 is a representation of the IQOS® 3 device, in which 33 represents the airflow of the IQOS® 3 device.

Figure 15:
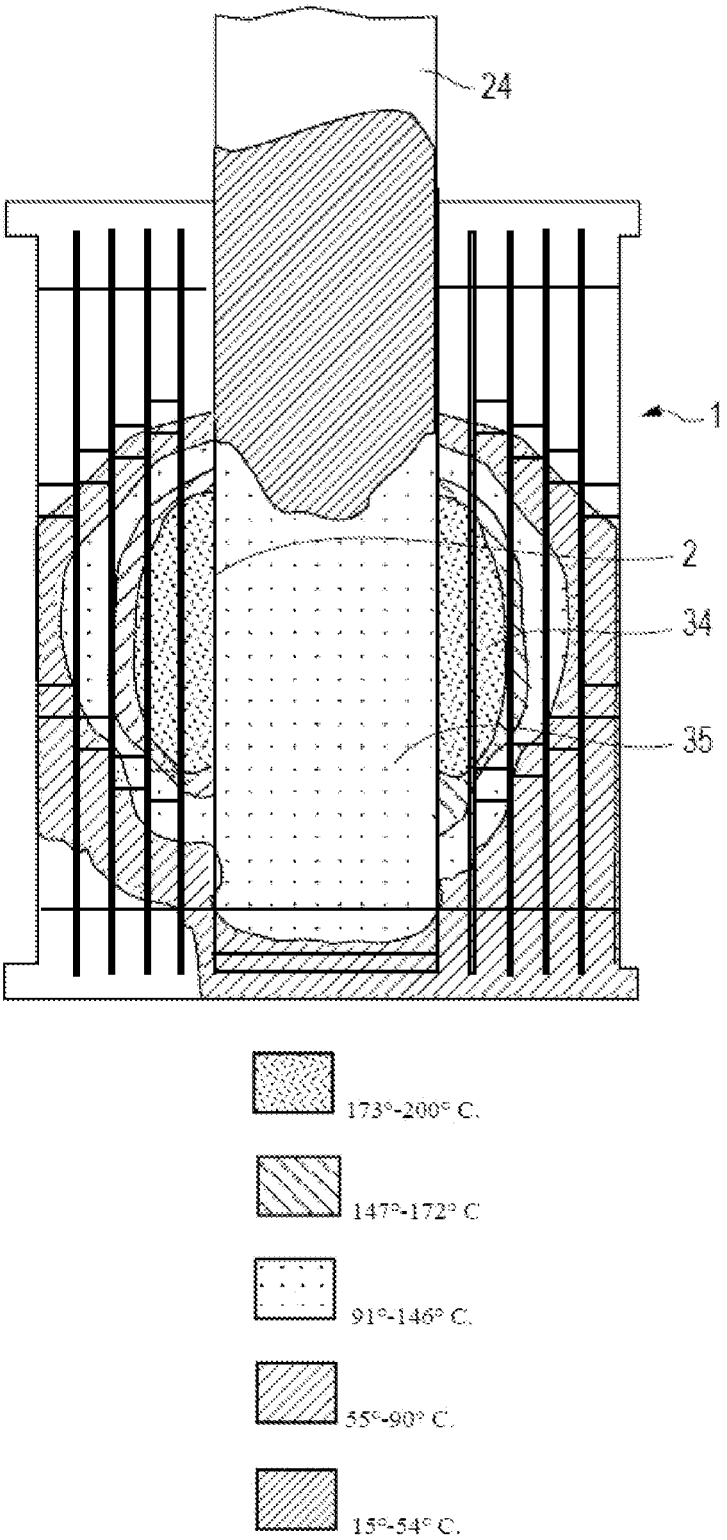
FIG. 15 illustrates the air temperature in the heat exchanger at the start of the smoking session. The close dots represent warm areas.
Figure 16:
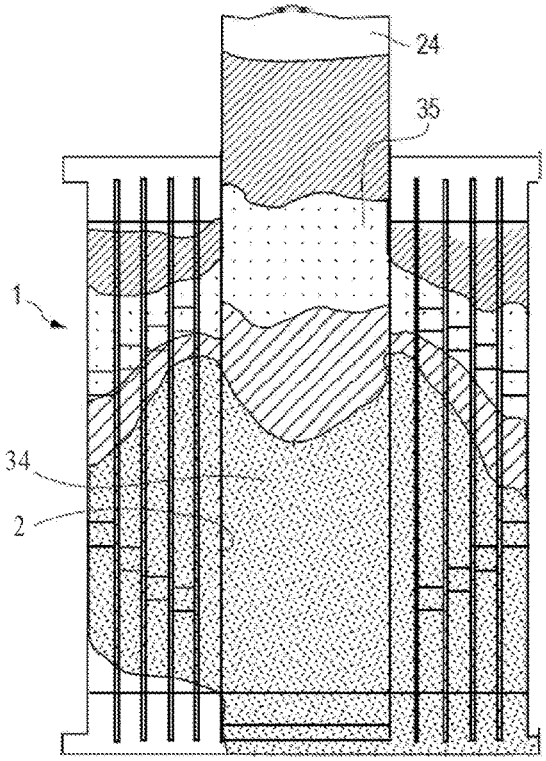
FIG. 16 illustrates the air temperature in the heat exchanger just the before the puff. The close dots represent warm areas and the heat is starting to concentrate in the tunnel containing the tobacco stick.
Figure 17:
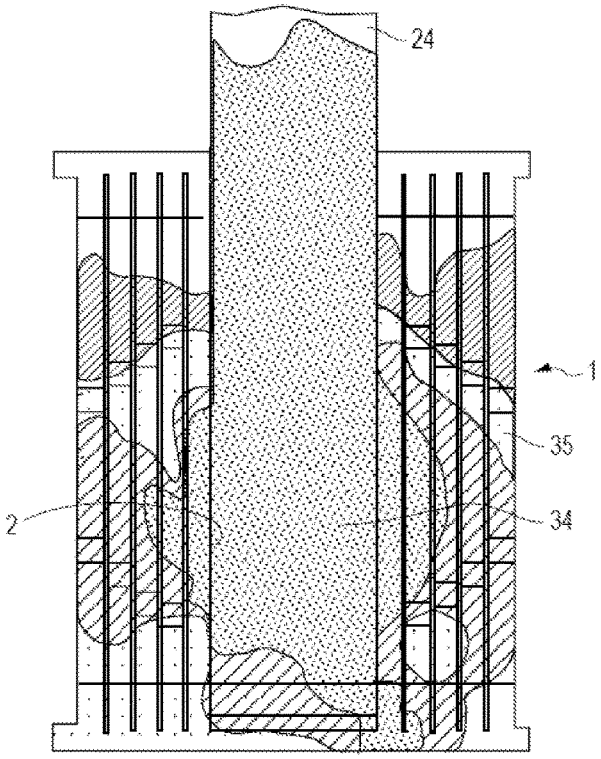
FIG. 17 illustrates the air temperature in the heat exchanger during the puff. The close dots represent warm areas and the heat is nearly fully concentrates in the tunnel containing the tobacco stick.

FIGS. 15-17 show one non-limiting example of temperature distributions within the heat exchanger and tobacco stick 24 at various stages of vaping. In FIGS. 15-17, the approximate temperature ranges, for illustrative purposes only, are represented by the stippling and hatching shown at the bottom of FIG. 15.

These temperature ranges are for illustrative purposes only in a single embodiment and are not intended to limit the temperature ranges that can be achieved in variations of this embodiment.

FIG. 15 illustrates the air temperature in the heat exchanger at the start of the smoking session (before any puff). The closely spaced dots 34 represent warmer areas around the heater (not shown). The farther spaced dots 35 represent cooler areas.

FIG. 16 illustrates the air temperature in the heat exchanger 1 just the before the puff. The closely spaced dots 34 represent warm areas and the heat is starting to concentrate in the tunnel containing the tobacco stick 24. The farther spaced dots 35 represent cooler areas.

FIG. 17 illustrates the air temperature in the heat exchanger 1 during the puff. The closely spaced dots 34 represent warm areas and the heat is nearly fully concentrated in the tunnel containing the tobacco stick 24. The close dots 34 represent warmer areas. The farther dots 35 represent cooler areas.

FIG. 18 represents an assembled mono-chamber heat exchanger 1' with non-spiral airflow. The heat exchanger 1' of FIG. 18 may be assembled with tape akin to that shown in FIG. 13. In the heat exchanger 1' of FIG. 18, 29 is the inlet hole, 30 are septa, and 31 is the airflow.

Figure 19:
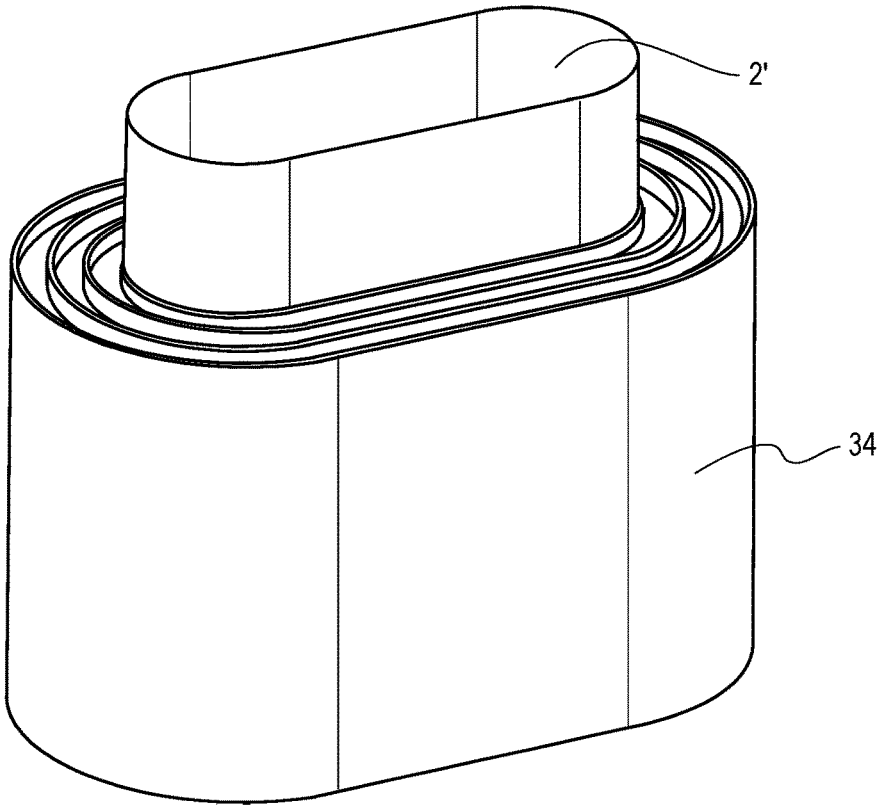
FIG. 19 illustrates a non-cylindrical tunnel, together with a heat exchanger, which may be optionally be used with loose herbs.
Figure 20:
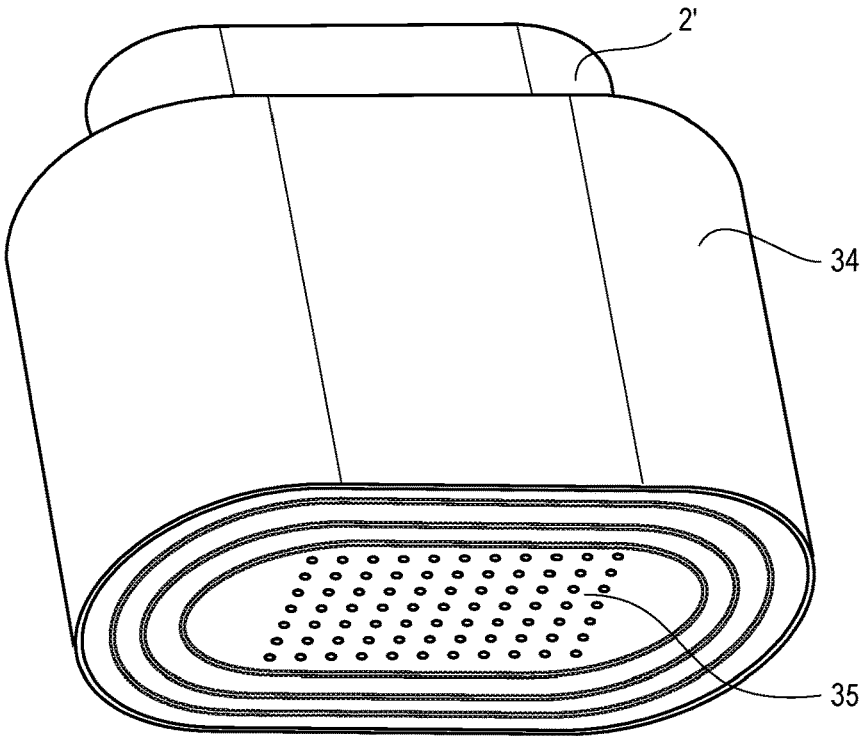
FIG. 20 illustrates a non-cylindrical tunnel, together with a heat exchanger, and a perforated bottom, which may be used with loose herbs.

FIGS. 19 and 20 illustrate a non-cylindrical tunnel 2', together with a heat exchanger, which may be optionally be used with loose herbs instead of a tobacco stick. 34 is the non-cylindrical heat exchanger.

FIG. 20 illustrates a non-cylindrical tunnel 2', together with a non-cylindrical heat exchanger 34, and a perforated bottom 35 of the tunnel 2', which may be used with loose herbs.

Figure 21:
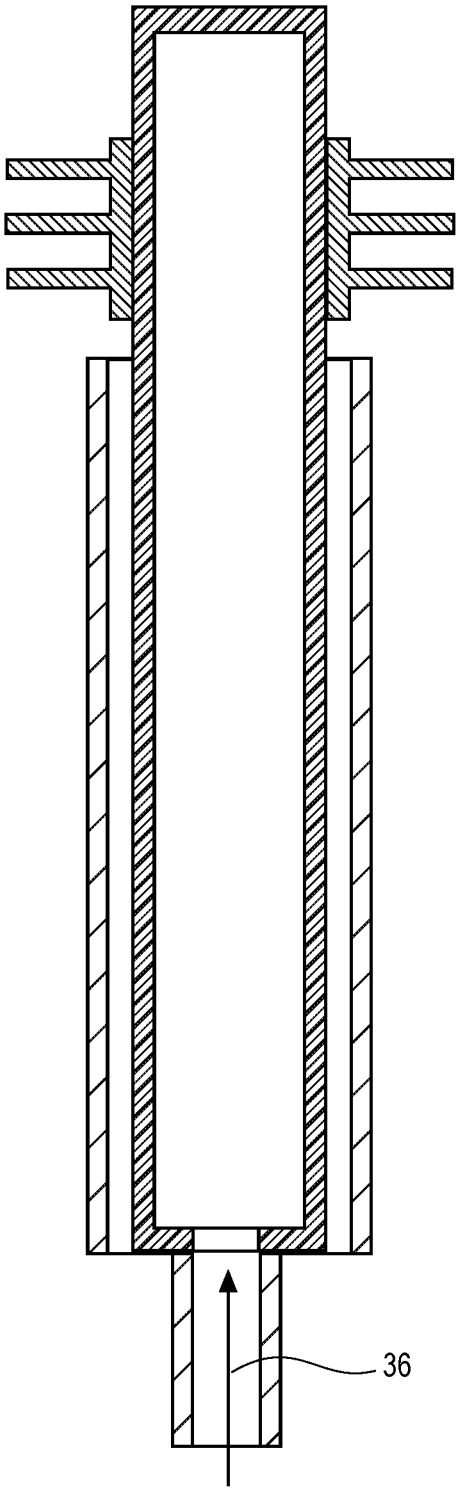
FIG. 21 shows the air flow of BAT's GLO® device.

FIG. 21 shows the air flow of BAT's GLO® device. 36 is the airflow from a bottom inlet.

Figure 22:
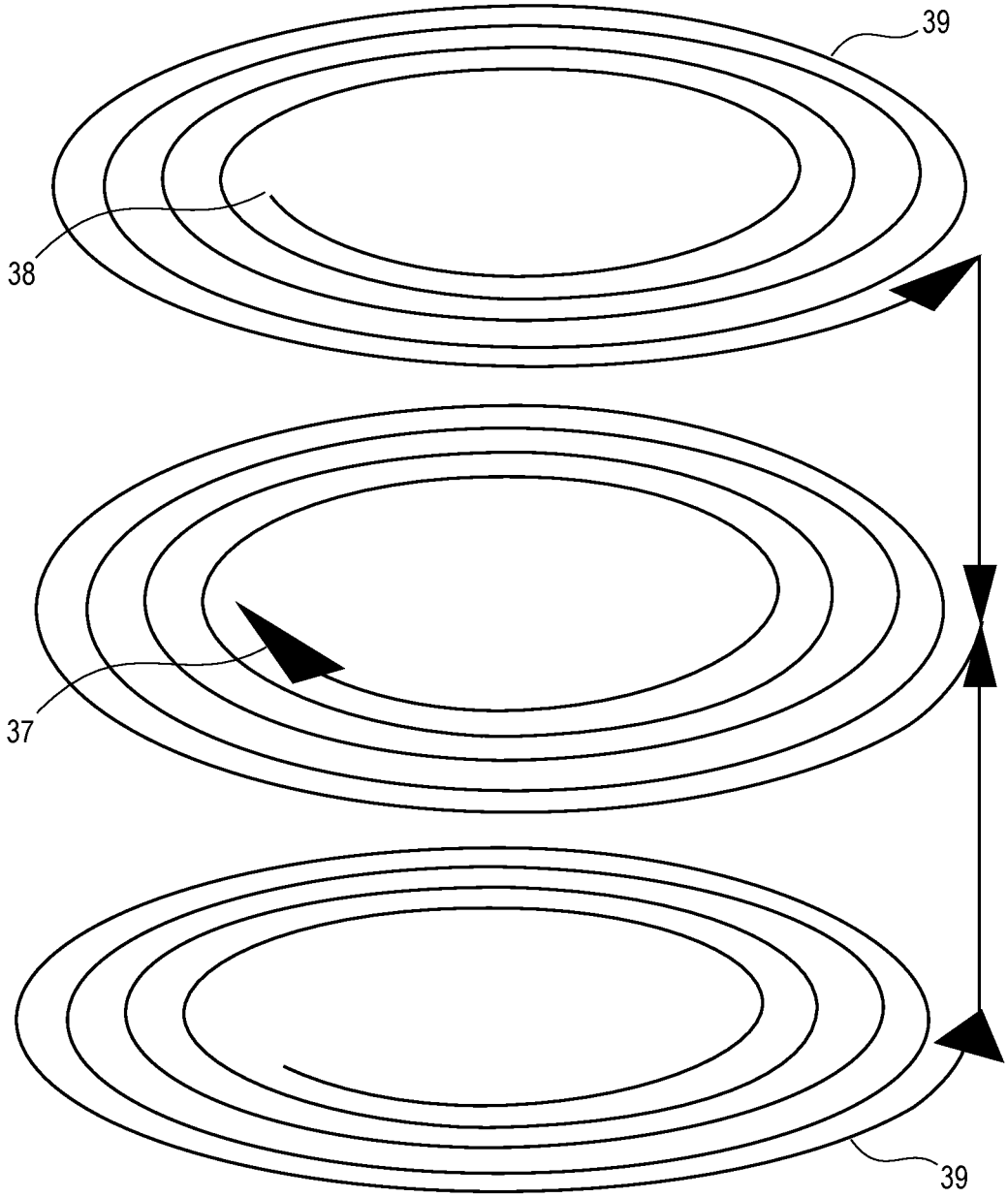
FIG. 22 is a schematic showing airflow in a spiral heat exchanger.

FIG. 22 is a schematic showing airflow in a spiral heat exchanger. 37 is air flow into the tobacco stick. 38 is the air entrance. 39 is heat transfer from the heater to the outside.

Figure 8:
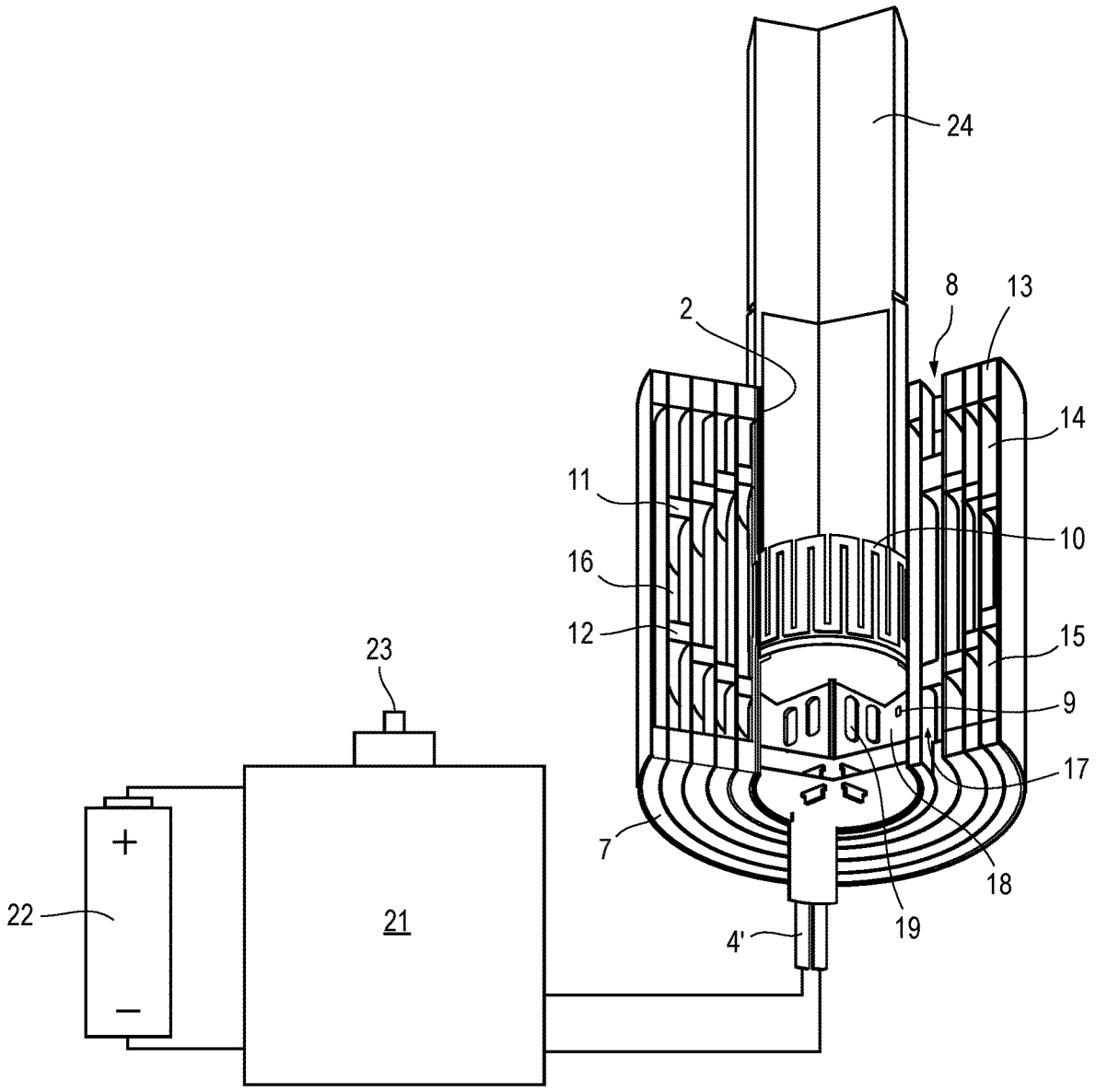
FIG. 8 illustrates an electronic device for heating of cigarettes—vapable tobacco sticks, comprising the heater for the vaporizer device with the air preheating element, wherein the electronic device and heated shown conventionally in different scales.
Figure 23:
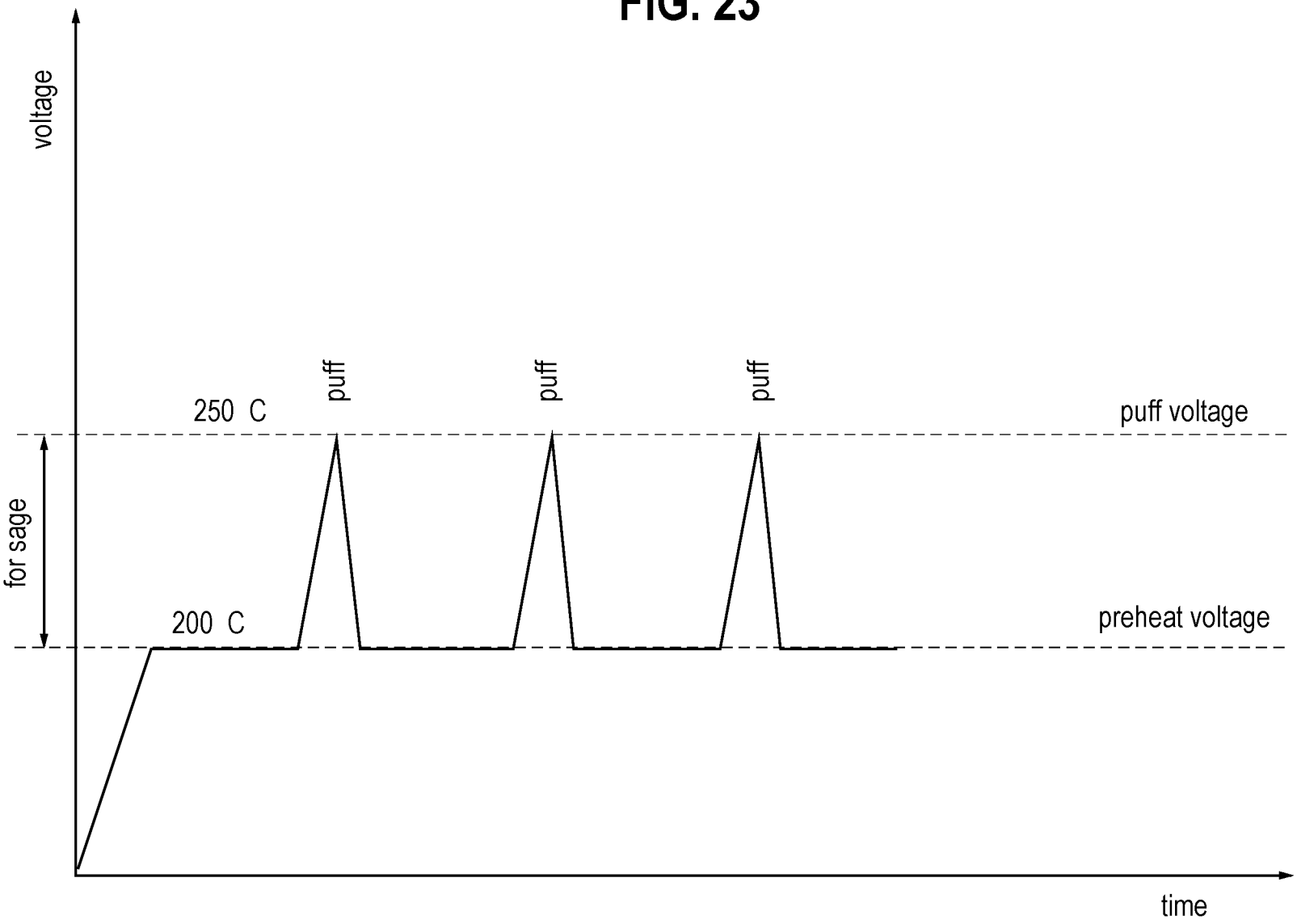
FIG. 23 shows forsage voltage and heating element temperature increases corresponding to puffs.

FIG. 23 shows forsage voltage and heating element temperature increases corresponding to puffs with a device exemplified in FIG. 8.

Depending on the signal from the temperature sensor 4, the controller installed in the electronic adjustment and control module 21 decreases or increases the PWM frequency. This ensures that the set temperature is maintained at a constant level. The duration of a vaping cycle is typically 3 to 4 minutes. The vaping cycle duration may be set shorter (i.e. 3 minutes, two minutes, or one minute or in each case approximately thereabout).

Duration of the warm up cycle—or time from turning on the device until the operating mode is reached—is minimized with certain embodiments of the present invention. The operating mode (i.e. operating temperature) is reached within period less than 30 seconds, preferably less than 15 seconds, more preferably less than 10 seconds, and most preferably less than 7 seconds. It is an object of the present invention to provide for such a short duration warm up cycle for a heating device made using the rolling technique for manufacturing described herein.

The claimed heater for a vaporizer device with air preheating has a simple design, which significantly improves its manufacturability, and when used as part of a portable or stationary electronic device intended for heating and vaporizing of tobacco sticks, is characterized by improved thermal insulation properties, so that the external wall of the casing practically does not heat up, or heat up substantially. It is an object of the present invention Because of the effective cooling function of the heat exchanger, the outer portion of the casing has a reduced temperature. The outer surface of the heat exchanger may reach a maximum temperature during the vaping session at least 35% lower than the maximum temperature of the heating element itself, preferably at least 45% lower or more than the maximum temperature of the heating element itself, most preferably at least 55% lower or more than the maximum temperature of the heating element itself. As demonstrated in the examples, even greater differentials are possible. See the results in Table 3, where the temperature of the outside of the heat exchanger is approximately 33% of the temperature of the heating element, for a temperature reduction of approximately 67%. Thus, embodiments of the present invention can allow for a heat differential of greater than 65%, comparing the temperature of the heater, with the outside of the heat exchanger.

The above information confirms the possibility of large-scale manufacture of a heater for a vaporizer device with air preheating in an industrial way at any specialized enterprise, and it can find wide application in vaping articles, in particular in heaters intended for use as part of a vaporizer device for vaping of cigarettes (tobacco sticks) without any, or the substantial absence of, pyrolysis (burning, smoldering) involved.

The outer case of the device may comprise any known shape. The case may optionally comprise insulative materials, including without limitation one or more vacuum chambers. In certain embodiments, the case extends outwards around the heat exchanger and then narrows below for easy holding of the device, i.e. the bottom of the device is narrower than the case is around the heat exchanger. Other case designs are contemplated.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

Example A Multiple Tests

The general purpose of the tests was to evaluate the spiral heat exchanger's ability to operate under certain temperature conditions, and determine performance characteristics. The tests were also intended to determine the efficiency and thermal insulation qualities of the spiral heat exchanger.

Six types of tests were performed: (1) "Power only while Puff" (without installing the heat exchanger in a plastic case); (2) "Power only while Puff" (with installing the heat exchanger in a plastic case); (3) "Pre Heat and Power while Session" (without installing the heat exchanger in a plastic case); (4) "Pre Heat and Power while Session" (with installing the heat exchanger in a plastic case); (5) "Preheat and Power Forsage while Puff" (without installing the heat exchanger in a plastic case); and (6) "Preheat and Power Forsage while Puff" (with installing the heat exchanger in a plastic case).

To determine the thermal efficiency of a multichannel duct, it is necessary to test the heater without the heat exchanger (i.e. the multichannel duct). These tests are for comparison with the results of tests 1-6 mentioned above. The tests of the heater without the heat exchanger are numbered 7-12: (7) "Power only while Puff" (without installing the heater in a plastic case); (8) "Power only while Puff" (with installing the heater in a plastic case); (9) "Pre Heat and Power while Session" (without installing the heater in a plastic case); (10) "Pre Heat and Power while Session" (with installing the heater in a plastic case); (11) "Preheat and Power Forsage while Puff" (without installing the heater in a plastic case); and (12) "Preheat and Power Forsage while Puff" (with installing the heater in a plastic case).

To identify possible breakdowns and deformation of the "Snail" heater exchanger it is also necessary to conduct a stress test in which 100 cigarettes will be smoked.

Test Conditions and Test Objectives

Tests of the heater in the "Power only while Puff" mode (without installing the heater in a plastic case). In this operating mode, voltage is applied to the heater only during a puff. During the test, it is desirable to determine: (a) the ability of the heater to quickly reach the required temperature; (b) the optimum heater temperature; (c) the temperature readings on the outer surface of the heater; (d) the Vape output volume (Conventional units) during the smoking session; (e) perform organoleptic smoke testing (vapor); (f) reach a conclusion about the suitability of this mode of operation for this test.

Test of the heater in the mode "Power only while Puff" (with the installation of the heater in a plastic case). In this operating mode, voltage is applied to the heater only during a puff. During the test, it is necessary to determine: (a) the ability of the heater to quickly reach the required temperature; (b) the optimum heater temperature (c) the temperature readings on the outer surface of the heater (d) the temperature indicators on the outer surface of the plastic case; (e) the Vape output volume (Conventional units) during the smoking session; (f) the effect of the plastic case on the temperature regime of the heater; (g) perform organoleptic smoke testing (vapor); (8) reach a conclusion about the suitability of this mode of operation.

Test of the heater in the mode "Pre Heat and Power while Session" (without installing the heater in a plastic case). In this operating mode, voltage is applied to the heater to preheat it, and the preset heating temperature is maintained throughout the entire smoking session. During the test, it is necessary to determine: (a) the preheat time needed to start a smoking session; (b) the optimum heater temperature; (c) the temperature readings on the outer surface of the heater; (d) the Vape output volume (Conventional units) during the smoking session; (e) perform organoleptic smoke testing (vapor); (f) reach a conclusion about the suitability of this mode of operation.

Test of the heater in the mode "Pre Heat and Power while Session" (with the installation of the heater in a plastic case). In this operating mode, voltage is applied to the heater to preheat it, and the preset heating temperature is maintained throughout the entire smoking session. During the test, it is necessary to determine: (a) the preheat time needed to start a smoking session; (b) the optimum heater temperature; (c) the temperature readings on the outer surface of the heater; (d) the temperature indicators on the outer surface of the plastic case; (e) the Vape output volume (Conventional units) during the smoking session; (f) the effect of the plastic case on the temperature regime of the heater; (g) perform organoleptic smoke testing (vapor) (8) reach a conclusion about the suitability of this mode of operation.

Test of the heater in the mode "Preheat and Power Forsage while Puff" (without installing the heater in a plastic case). In this operating mode, voltage is applied to the heater to preheat it and the standby temperature is maintained throughout the session. During tightening, an increased voltage is applied to the heater, and thus the temperature increases during tightening. During the test, it is necessary to determine: (a) the preheat time needed to start a smoking session; (b) the optimum heater temperature; (c) the temperature readings on the outer surface of the heater; (d) the Vape output volume (Conventional units) during the smoking session; (5*e*) do organoleptic smoke testing (vapor); (f) reach a conclusion about the suitability of this mode of operation.

Test of the heater in the mode "Preheat and Power Forsage while Puff (with the installation of the heater in a plastic case). In this operating mode, voltage is applied to the heater to preheat it and the standby temperature is maintained throughout the session. During tightening, an increased voltage is applied to the heater, and thus the temperature increases during tightening. During the test, it is necessary to determine: (a) the preheat time needed to start a smoking session; (b) the optimum heater temperature; (c) the temperature readings on the outer surface of the heater; (d) the temperature indicators on the outer surface of the plastic case; (e) the Vape output volume (Conventional units) during the smoking session; (f) the effect of the plastic case on the temperature regime of the heater (g) perform organoleptic smoke testing (vapor); (h) reach a conclusion about the suitability of this mode of operation.

Test of the heater without multichannel air duct in the mode "power only while puff" (without installing the heater in a plastic case). In this operating mode, voltage is applied to the heater only during a puff. During the test, it is necessary to determine: (a) the ability of the heater to quickly reach the required temperature; (b) the optimum heater temperature; (c) Determine the temperature readings on the outer surface of the heater; (d) the Vape output volume (Conventional units) during the smoking session; (e) perform organoleptic smoke testing (vapor); (f) note the difference with the parameters obtained in Test No. (1).

Test of the heater without multichannel air duct in the mode "Power only while Puff" (with the installation of the heater in a plastic case). In this operating mode, voltage is applied to the heater only during a puff. During the test, it is necessary to determine: (a) the ability of the heater to quickly reach the required temperature; (b) the optimum heater temperature; (c) the temperature readings on the outer surface of the heater; (d) the temperature indicators on the outer surface of the plastic case; (e) the Vape output volume (Conventional units) during the smoking session; (f) the effect of the plastic case on the temperature regime of the heater; (g) perform organoleptic smoke testing (vapor); (h) note the difference with the parameters obtained in Test No. (2).

Test of the heater without multichannel air duct in the mode "Pre Heat and Power while Session" (without installing the heater in a plastic case). In this operating mode, voltage is applied to the heater to preheat it, and the preset heating temperature is maintained throughout the entire smoking session. During the test, it is necessary to determine: (a) the preheat time needed to start a smoking session; (b) the optimum heater temperature; (c) the temperature readings on the outer surface of the heater; (d) the Vape output volume (Conventional units) during the smoking session; (e) perform organoleptic smoke testing (vapor); (f) note the difference with the parameters obtained in Test No. (3).

Test of the heater without multichannel air duct in the mode "Pre Heat and Power while Session" (with the installation of the heater in a plastic case). In this operating mode, voltage is applied to the heater to preheat it, and the preset heating temperature is maintained throughout the entire smoking session. During the test, it is necessary to determine: (a) the preheat time needed to start a smoking session; (b) the optimum heater temperature; (3cthe temperature readings on the outer surface of the heater; (d) the temperature indicators on the outer surface of the plastic case; (e) the Vape output volume (Conventional units) during the smoking session; (f) the effect of the plastic case on the temperature regime of the heater; (g) perform organoleptic smoke testing (vapor); and (h) note the difference with the parameters obtained in Test No. (4).

Test of the heater without multichannel air duct in the mode "Preheat and Power Forsage while Puff (without installing the heater in a plastic case). In this operating mode, voltage is applied to the heater to preheat it and the standby temperature is maintained throughout the session. During tightening, an increased voltage is applied to the heater, and thus the temperature increases during tightening. During the test, it is necessary to determine: (a) the preheat time needed to start a smoking session; (b) the optimum heater temperature; (c) the temperature readings on the outer surface of the heater; (d) the temperature indicators on the outer surface of the plastic case; (e) the Vape output volume (Conventional units) during the smoking session (f) perform organoleptic smoke testing (vapor); and (g) note the difference with the parameters obtained in Test No. (5).

Test of the heater without multichannel air duct in the mode "Preheat and Power Forsage while Puff" (with the installation of the heater in a plastic case). In this operating mode, voltage is applied to the heater to preheat it and the standby temperature is maintained throughout the session. During tightening, an increased voltage is applied to the heater, and thus the temperature increases during tightening. During the test, it is necessary to determine: (a) the preheat time needed to start a smoking session; (b) the optimum heater temperature; (c) the temperature readings on the outer surface of the heater; (d) the temperature indicators on the outer surface of the plastic case; (e) the Vape output volume (Conventional units) during the smoking session; (f) the effect of the plastic case on the temperature regime of the heater; (g) perform organoleptic smoke testing (vapor); and (h) note the difference with the parameters obtained in Test No. (6).

Stress Test

It is necessary to test the heater with the multi-channel duct in the mode "Preheat and power during the session" (with the installation of the heater in a plastic case). Test mode and conditions: (a) it is necessary to smoke 50-100 cigarette sticks on the smoking machine; (b) puff volume: 55 ml; (c) puff time: 3 sec; (d) rest time: 30 sec; (e) heater Internal temperature: 235 degrees Celsius.

By forsage is generally meant herein that preheating occurs/initiated and then during a puff the voltage increases which results in an increase of the temperature of the heater. Therefore, forsage generally represents the preheating, plus added voltage (and/or elevated heating temperature during the puff. Even more specifically, forsage may mean increased voltage to one heater, but may also mean using an additional heater during a puff, as applicable. See FIG. 23. Preferably, forsage increases the heating element from 25° to 85° C. (as compared to baseline heat), more preferably 35°–65° C., most preferably 45° to 55° C. Voltage, in certain embodiments, may range from 2 to 6 volts.

Testing involved, inter alia, the following materials and/or equipment: Smoking machine MC VAC 1.3; Digital multimeter Rigol DM3058 (2 pcs); Power supply DP 811; Infrared laser pyrometer LTCF1-CB3; Sensor PT 100 (2 pcs); PCB (Printed Circuit Board) with Temperature control; and a computer with installed software Mathlab and software for PID regulator.

The test bench is required for testing the Snail heater in various operating modes. The test bench is assembled in such a way that it allows simulating the process of smoking a cigarette stick as recommended by Coresta (Cooperation Centre for Scientific Research Relative to Tobacco). Accordingly, all parameters described in each specific task are recorded. Depending on the task at hand, the configuration of the test bench changes slightly. The MC VAC 1.3 smoking machine is used in the test bench to create conditions that simulate the puff of a cigarette by a smoker. The smoking machine is set in such a way that the puff volume is 55 ml, the puff time is 3 seconds, the pause between puffs is 30 seconds. The sensor of the smoking machine records the amount of vapor in the puff, this recorded parameter can then be used for comparison with the performance of a serial vaporizer. In the present test/s, it was compared to the IQOS® 3 vaporizer. To measure the temperature directly in the heating zone, we used a PT100 temperature sensor.

The Infrared laser pyrometer LTCF1-CB was used to measure the temperature on the outside of the Snail heater. In the tests where it was necessary to measure the temperature on the outside of the "Snail" heater when the heater was placed in a plastic case, a PT100 temperature sensor was placed between the plastic case and the "Snail" heater. The temperature on the outside of the plastic case was measured in these tests using an Infrared laser pyrometer LTCF1-CB3.

To measure and register changes in the signal from the temperature sensors, a Rigol DM3058 digital multimeter was used, which in turn transmitted the data to a computer. A DP 811 was used to provide power supply.

For the tests described herein, the types of "Snail" heater sample used was selected, from heat exchanger "Snail" with air duct, or heater heat exchanger "Snail" without air duct. With any of the described samples, the heater "Snail" is either installed, or not installed, in any suitable type of a plastic case. Testing methodology is generally as follows. A tobacco stick is installed in the "Snail" heater chamber. A steam pipe is connected to the filter of the cigarette stick, in which a vacuum is created by the smoking machine. At the start of the test, the "Snail" heater is energized. The tobacco substrate in the cigarette stick is heated and the active substance is released from it together with the vapor. The smoking machine takes ten puffs. During the smoking machine puff session, temperature sensors measure the temperature inside the heater and the temperature on the outside of the heat exchanger. The vape sensor installed in the smoking machine records the amount of vape in the puff. Data is received from sensors to a computer (PC). A Mathlab software plots graphics based on the data received. Using these metrics, we the results of each test were tabulated. Subsequently, the data obtained was analyzed and a conclusion was reached regarding each test results.

Results of test/s of the heater in the mode "Power only while Puff" (without the installation of the heater in a plastic case) are depicted in Table 1 below. In this operating mode, voltage is applied to the heater only during a puff

TABLE 1

| Parameter | Test 1 | Test 2 | Test 3 | Test 4 |
|---|---|---|---|---|
| Snail Vape output (Conventional units) | 1800-1970 | 1820-6410 | 1815-11830 | 1805-14885 |
| IQOS ® Vape output (Conventional units) | 1800-6281 | | | |
| Vape generation occurs, puff No | No Vape | 10 | 6 | 5 |
| Temperature PID | 220 | 250 | 250 | 250 |
| Heater Internal temperature, C. (Max) | 165 | 280 | 303 | 317 |
| Heat Exchanger Outer temperature, C. (Max) | 48 | 62 | 78 | 78 |
| Voltage, V | 4.2 | 6 | 8 | 10 |
| Optimal Internal temperature, C. | — | — | — | — |
| Organoleptic test | — | — | — | — |
| Applicability of this mode for use | No | No | No | No |

Results of test/s of the heater in the mode "Power only while Puff" (with the installation of the heater in a plastic case) are depicted in table 2 below. In this operating mode, voltage is applied to the heater only during a puff

TABLE 2

| Parameter | Test 1 | Test 2 | Test 3 | Test 4 |
|---|---|---|---|---|
| Snail Vape output (Conventional units) | 1790-1955 | 1800-4661 | 1800-8610 | 1800-9500 |
| IQOS ® Vape output (Conventional units) | 1800-6281 | | | |
| Vape generation occurs, puff No | No Vape | 10 | 8 | 7 |
| Temperature PID | 250 | 250 | 250 | 250 |
| Heater Internal temperature, C. (Max) | 157 | 263 | 300 | 310 |
| Heat Exchanger Outer temperature, C. (Max) | 42 | 57 | 63 | 70 |
| Outer temperature at the Case, C. (Max) | 34 | 41 | 45 | 48 |
| Voltage | 4.2 | 6 | 8 | 10 |
| Optimal Internal temperature, C. | | | | |
| Organoleptic test | | | | |
| Applicability of this mode for use | No | No | No | No |

Results of test/s of the heater in the mode "Preheat and Power while Session" (without installing the heat exchanger in a plastic case) are depicted in Table 3 below. In this operating mode, voltage is applied to the heater to preheat it, and the preset heating temperature is maintained throughout the entire smoking session. (without installing the heater in a plastic case)

TABLE 3

| Parameter | Test 1 | Test 2 | Test 3 | Test 4 |
|---|---|---|---|---|
| Snail Vape output (Conventional units) | 1800-7425 | 1818-7655 | 1716-7500 | 1805-8430 |
| IQOS ® Vape output (Conventional units) | 1800-6281 | | | |
| Vape generation occurs, puff No | 2 | 2 | 2 | 2 |

TABLE 3-continued

| Parameter | Test 1 | Test 2 | Test 3 | Test 4 |
|---|---|---|---|---|
| Temperature PID | 225 | 230 | 240 | 260 |
| Preheat Time, sec | 5 | 5 | 10 | 20 |
| Heater Internal temperature, C. (Max) | 215-230 | 225-240 | 235-250 | 255-270 |
| Heater Exchanger Outer temperature, C. (Max) | 72 | 79 | 80 | 86 |
| Voltage, V | 4.2 | 4.2 | 4.2 | 4.2 |
| Optimal Internal temperature, C. | 230-235 | | | |
| Organoleptic test | Good taste | Good taste | Good taste | Slightly overheated taste |
| Applicability of this mode for use | Yes | Yes | Yes | No |

Results of test/s of the heater in the mode "Preheat and Power while Session" (with the installation of the heater in a plastic case) are depicted in table 4 below. In this operating mode, voltage is applied to the heater to preheat it, and the preset heating temperature is maintained throughout the entire smoking session.

TABLE 4

| Parameter | Test 1 | Test 2 | Test 3 | Test 4 |
|---|---|---|---|---|
| Snail Vape output (Conventional units) | 1810-6280 | 1830-6735 | 1815-7620 | 1820-8870 |
| IQOS ® Vape output (Conventional units) | 1800-6281 | | | |
| Vape generation occurs, puff No | 2 | 2 | 2 | 2 |
| Temperature PID | 225 | 230 | 240 | 260 |
| Preheat Time, sec | 5 | 5 | 10 | 20 |
| Heater Internal temperature, C. (Max) | 220-225 | 225-240 | 230-250 | 250-260 |
| Heater Exchanger Outer temperature, C. (Max) | 78 | 81 | 85 | 90 |
| Outer temperature at the Case, C. (Max) | 46 | 46 | 48 | 51 |
| Voltage, V | 4.2 | 4.2 | 4.2 | 4.2 |
| Optimal Internal temperature, C. | 225-235 | | | |
| Organoleptic test | Good taste | Good taste | Slightly overheated taste | Slightly overheated taste |
| Applicability of this mode for use | Yes | Yes | No | No |

Results of test/s of the heater in the mode "Preheat and Power Forsage while Puff" (without installing the heater in a plastic case) are depicted in table 5 below. In this operating mode, voltage is applied to the heater to preheat it and the standby temperature is maintained throughout the session. During tightening, an increased voltage is applied to the heater, and thus the temperature increases during tightening. In Forsage, the electronics have been configured as follows: the temperature of the heating element in standby mode (when the user does not puff) has been set to a certain level. This temperature was controlled by a PID regulator and maintained at the required level. The voltage at this moment changed, as it is necessary to stabilize the temperature at a given level. This voltage can take values from 3 to 10 volts and have different pulse durations. Therefore, we do not indicate these values but indicate the set temperature. At the same time, a limit was set for the peak voltage value that was applied to the heating element during tightening. It is these values that are present in the tables that relate to such a test.

TABLE 5

| Parameter | Test 1 | Test 2 | Test 3 | Test 4 |
|---|---|---|---|---|
| Snail Vape output (Conventional units) | 1800-4246 | 1800-5950 | 1800-6500 | 1800-6973 |
| IQOS ® Vape output (Conventional units) | 1800-6281 | | | |
| Vape generation occurs, puff No | 7 | 6 | 6 | 5 |
| Temperature forsage PID | 250 | 250 | 250 | 250 |
| Preheat Time, sec | 10 | 10 | 10 | 10 |
| Preheat temperature, C. | 200 | 180 | 190 | 200 |
| Heater Internal temperature, C. (Max) | 250 | 267 | 268 | 270 |
| Heater Exchanger Outer temperature, C. (Max) | 64 | 71 | 72 | 73 |
| Voltage, V | 4.2 | 6 | 6 | 6 |
| Optimal Internal temperature, C. | 250 | | | |
| Organoleptic test | Good taste | Good taste | Good taste | Good taste |
| Applicability of this mode for use | No | No | No | No |

Results of test/s of the heater in the mode "Preheat and Power Forsage while Puff" (with the installation of the heater in a plastic case) are depicted in table 6 below. In this operating mode, voltage is applied to the heater to preheat it and the standby temperature is maintained throughout the session. During tightening, an increased voltage is applied to the heater, and thus the temperature increases during tightening.

TABLE 6

| Parameter | Test 1 | Test 2 | Test 3 | Test 4 |
|---|---|---|---|---|
| Snail Vape output (Conventional units) | 1800-4160 | 1790-5400 | 1800-5990 | 1785-6885 |
| IQOS ® Vape output (Conventional units) | 1800-6281 | | | |
| Vape generation occurs, puff No | 7 | 6 | 6 | 5 |
| Temperature forsage PID | 250 | 250 | 250 | 250 |
| Preheat Time, sec | 10 | 10 | 10 | 10 |
| Preheat temperature, C. | 200 | 180 | 190 | 200 |
| Heater Internal temperature, C. (Max) | 250 | 268 | 270 | 270 |
| Heat Exchanger Outer temperature, C. (Max) | 66 | 64 | 65 | 66 |
| Outer temperature at the Case, C. (Max) | 44 | 44 | 45 | 45 |
| Voltage, V | 4.2 | 6 | 6 | 6 |
| Optimal Internal temperature, C. | 250 | | | |
| Organoleptic test | Good taste | Good taste | Good taste | Good taste |
| Applicability of this mode for use | No | No | No | No |

Results of test/s of the heater without multichannel duct in the mode "Power only while Puff" (without the installation of the heater in a plastic case) are depicted in table 7 below. In this operating mode, voltage is applied to the heater only during a puff.

TABLE 7

| Parameter | Test 1 | Test 2 | Test 3 | Test 4 |
|---|---|---|---|---|
| Snail Vape output (Conventional units) | 1800-1956 | 1800-6452 | 1800-11721 | 1801-14756 |
| IQOS ® Vape output (Conventional units) | 1800-6281 | | | |
| Vape generation occurs, puff No | No Vape | 10 | 5 | 5 |
| Temperature PID | 220 | 250 | 250 | 250 |
| Heater Internal temperature, C. (Max) | 167 | 283 | 306 | 321 |
| Heat Exchanger Outer temperature, C. (Max) | 167 | 283 | 306 | 321 |
| Voltage, V | 4.2 | 6 | 8 | 10 |
| Optimal Internal temperature, C. | — | — | — | — |
| Organoleptic test | — | — | — | — |
| Applicability of this mode for use | No | No | No | No |

Results of tes/st of the heater without multichannel duct in the mode "Power only while Puff" (with the installation of the heater in a plastic case) are depicted in Table 8 below. In this operating mode, voltage is applied to the heater only during a puff.

TABLE 8

| Parameter | Test 1 | Test 2 | Test 3 | Test 4 |
|---|---|---|---|---|
| Snail Vape output (Conventional units) | 1800-2100 | 1800-2100 | 1800-2100 | 1800-2500 |
| IQOS ® Vape output (Conventional units) | 1800-6281 | | | |
| Vape generation occurs, puff No | No Vape | No Vape | No Vape | No Vape |
| Temperature PID | 250 | 250 | 250 | 250 |
| Heater Internal temperature, C. (Max) | 151 | 215 | 232 | 244 |
| Heater Exchanger Outer temperature, C. (Max) | 151 | 215 | 232 | 244 |
| Outer temperature at the Case, C. (Max) | 35 | 40 | 44 | 45 |
| Voltage | 4.2 | 6 | 8 | 10 |
| Optimal Internal temperature, C. | — | — | — | — |
| Organoleptic test | — | — | — | — |
| Applicability of this mode for use | No | No | No | No |

Results of test/s of the heater without multichannel duct in the mode "Preheat and Power while Session" (without installing the heater in a plastic case) are depicted in table 9 below. In this operating mode, voltage is applied to the heater to preheat it, and the preset heating temperature is maintained throughout the entire smoking session.

TABLE 9

| Parameter | Test 1 | Test 2 | Test 3 | Test 4 |
|---|---|---|---|---|
| Snail Vape output (Conventional units) | 1800-5875 | 1800-5145 | 1800-6910 | 1800-7650 |
| IQ0S ® Vape output (Conventional units) | | 1800-6281 | | |
| Vape generation occurs, puff No | 4 | 4 | 4 | 3 |
| Temperature PID | 220 | 225 | 240 | 260 |
| Preheat Time, sec | 5 | 5 | 10 | 10 |
| Heater Internal temperature, C. (Max) | 225 | 230 | 240 | 260 |
| Heat Exchanger Outer temperature, C. (Max) | 225 | 230 | 240 | 260 |
| Voltage, V | 4.2 | 4.2 | 4.2 | 4.2 |
| Optimal Internal temperature, C. | | 230- 235 | | |
| Organoleptic test | Good taste | Good taste | Good taste | Slightly overheated taste |
| Applicability of this mode for use | No | No | No | No |

Results of test/s of the heater without multichannel duct in the mode "Preheat and Power while Session" (with the installation of the heater in a plastic case) are depicted in Table 10 below. In this operating mode, voltage is applied to the heater to preheat it, and the preset heating temperature is maintained throughout the entire smoking session.

TABLE 10

| Parameter | Test 1 | Test 2 | Test 3 | Test 4 |
|---|---|---|---|---|
| Snail Vape output (Conventional units) | 1800-5660 | 1800-7380 | 1800-8380 | 1800-9890 |
| IQOS ® Vape output (Conventional units) | | 1800-6281 | | |
| Vape generation occurs, puff No | 4 | 3 | 3 | 2 |
| Temperature PID | 225 | 230 | 240 | 260 |
| Preheat Time, sec | 5 | 5 | 10 | 10 |
| Heater Internal temperature, C. (Max) | 231 | 236 | 247 | 266 |
| Heat Exchanger Outer temperature, C. (Max) | 231 | 236 | 247 | 266 |
| Outer temperature at the Case, C. (Max) | 54 | 56 | 60 | 60 |
| Voltage, V | 4.2 | 4.2 | 4.2 | 4.2 |
| Optimal Internal temperature, C. | | 230-235 | | |
| Organoleptic test | Good taste | Good taste | Good taste | Slightly overheated taste |
| Applicability of this mode for use | No | No | No | No |

Results of test/s of the heater without multichannel duct in the mode "Preheat and Power Forsage while Session" (without installing the heater in a plastic case) are depicted in Table 11 below. In this operating mode, voltage is applied to the heater to preheat it and the standby temperature is maintained throughout the session. During tightening, an increased voltage is applied to the heater, and thus the temperature increases during tightening.

TABLE 11

| Parameter | Test 1 | Test 2 | Test 3 | Test 4 |
|---|---|---|---|---|
| Snail Vape output (Conventional units) | 1805-4616 | 1805-5300 | 1805-6025 | 1800-6020 |
| IQOS ® Vape output (Conventional units) | | 1800-6281 | | |
| Vape generation occurs, puff No | 6 | 6 | 5 | 5 |
| Temperature PID | 250 | 250 | 250 | 250 |
| Preheat Time, sec | 10 | 10 | 10 | 10 |
| Preheat temperature, C. | 200 | 180 | 190 | 200 |
| Heater Internal temperature, C. (Max) | 250 | 265 | 270 | 275 |
| Heat Exchanger Outer temperature, C. (Max) | 250 | 250 | 270 | 275 |
| Voltage, V | 4.2 | 6 | 6 | 6 |
| Optimal Internal temperature, C. | | 275 | | |
| Organoleptic test | Good taste | Good taste | Good taste | Good taste |
| Applicability of this mode for use | No | No | No | No |

Results of test/s of the heater without multichannel duct in the mode "Preheat and Power Forsage while Session" (with the installation of the heater in a plastic case) are depicted in Table 12 below. In this operating mode, voltage is applied to the heater to preheat it and the standby temperature is maintained throughout the session. During tightening, an increased voltage is applied to the heater, and thus the temperature increases during tightening.

TABLE 12

| Parameter | Test 1 | Test 2 | Test 3 | Test 4 |
|---|---|---|---|---|
| Snail Vape output (Conventional units) | 1800-4065 | 1800-3500 | 1800-4380 | 1800-4380 |
| IQOS ® Vape output (Conventional units) | | 1800-6281 | | |
| Vape generation occurs, puff No | 6 | 6 | 5 | 5 |
| Temperature PID | 250 | 250 | 250 | 250 |
| Preheat Time, sec | 10 | 10 | 10 | 10 |
| Preheat temperature, C. | 200 | 180 | 190 | 200 |
| Heater Internal temperature, C. (Max) | 244 | 247 | 261 | 259 |
| Heat Exchanger outer temperature, C. (Max) | 244 | 247 | 261 | 259 |
| Outer temperature at the Case, C. (Max) | 48 | 47 | 46 | 49 |
| Voltage, V | 4.2 | 6 | 6 | 6 |
| Optimal Internal temperature, C. | | 259 | | |
| Organoleptic test | Good taste | Good taste | Good taste | Good taste |
| Applicability of this mode for use | No | No | No | No |

Discussion of the Tests Results

Operating Mode "Power Only while Puff"

Test results related to this operating mode are presented in Table 1, Table 2, Table 7, and Table 8. Generally, the results depicted in the Tables mentioned above indicate that the operation of the heater in the "Power only while Puff" mode, using the testing conditions, does not achieve rapid heating of the tobacco substrate. This is influenced by the inertia of heating the body of the tobacco stick and the relatively short time for applying a voltage to the heating element. Substantial voltage increases, or greater heating element efficiency, or use of a penetrative heating element may have given a different result.

It is observed that, vapor can be obtained after 5 puffs in the variant when the heater is not placed in a plastic case (Table1). However in test No. 2 (2), the heater is housed in a plastic case, and vapor can be obtained at 7 puffs. It may be that part of the energy is taken away by the plastic body, although the body has only a small area of direct contact with the heater body. The numbers above (tests 4 in Tables 1 and 2) represent the best results of these two operating modes. The thermal insulation qualities of the heater operating in the "Power only while Puff" mode can be evaluated by comparing the data from Table 1-Table 7, and Table 2-Table 8, respectively.

As can be seen in Table 1 (Test 4) the temperature difference between the inside of the heater and the outside of the heat exchanger is about 239° C., which is an extraordinary differential. A temperature differential of 150° C., preferably 175° C., most preferably 200° C., is desired in certain embodiments.

As can be seen from Table 2 (Test 4), the temperature difference between the inside of the heater and its outer surface is 240° C., and the temperature on the outer surface of the plastic case is 49° C. This is an excellent and impressive thermal insulation result. A temperature differential greater than 100° C., preferably 175° C., most preferably 200° C., is desired in certain embodiments.

The tables below show the parameters of respective tests for comparison.

TABLE 1

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1800-1970 | 1820- | 1815- | 1805 |
| Iqos Vape output (Conventional | | 1800-6281 | | |
| Vape generation occurs, puff No | No Vape | 10 | 6 | 5 |
| Temperature PID | 220 | 250 | 250 | 250 |
| Heater internal temperature, C. | 165 | 280 | 303 | 317 |
| Heater outer temperature, C. (Max) | 48 | 62 | 78 | 78 |
| Voltage, V | 4.2 | 6 | 8 | 10 |
| Optimal internal temperature, C. | — | — | — | — |
| Organoleptic test | — | — | — | — |
| Applicability of this mode for use | No | No | No | No |

TABLE 7

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1800-1965 | 1800- | 1800- | 1801- |
| Iqos Vape output (Conventional | | 1800-6281 | | |
| Vape generation occurs, puff No | No Vape | 10 | 5 | 5 |
| Temperature PID | 220 | 250 | 250 | 250 |
| Heater internal temperature, C. | 167 | 283 | 306 | 321 |
| Heater outer temperature, C. (Max) | 167 | 283 | 306 | 321 |
| Voltage, V | 4.2 | 6 | 8 | 10 |
| Optimal internal temperature, C. | — | — | — | — |
| Organoleptic test | — | — | — | — |
| Applicability of this mode for use | No | No | No | No |

TABLE 2

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1790-1955 | 1800- | 1800-8610 | 1800-9500 |
| Iqos Vape output (Conventional | | 1800-6281 | | |
| Vape generation occurs, puff No | No Vape | 10 | 8 | 7 |
| Temperature PID | 220 | 250 | 250 | 250 |
| Heater internal temperature, C. | 157 | 263 | 300 | 310 |
| Heater outer temperature, C. (Max) | 42 | 57 | 63 | 70 |
| Outer temperature at the Case, C. | 34 | 41 | 45 | 48 |
| Voltage, V | 4.2 | 6 | 8 | 10 |
| Optimal internal temperature, C. | — | — | — | — |
| Organoleptic test | — | — | — | — |
| Applicability of this mode for use | No | No | No | No |

TABLE 8

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1800-2100 | 1800- | 1800-2100 | 1800-2500 |
| Iqos Vape output (Conventional | | 1800-6281 | | |
| Vape generation occurs, puff No | No Vape | No Vape | No Vape | No Vape |
| Temperature PID | 250 | 250 | 250 | 250 |
| Heater internal temperature, C. | 151 | 215 | 232 | 244 |
| Heater outer temperature, C. (Max) | 151 | 215 | 232 | 244 |
| Outer temperature at the Case, C. | 35 | 40 | 44 | 45 |
| Voltage, V | 4.2 | 6 | 8 | 10 |
| Optimal internal temperature, C. | — | — | — | — |
| Organoleptic test | — | — | — | — |

TABLE 8-continued ("Heater Outer Temperature" refers to Heat Exchanger Outer Temperature):

| Parameter | Test 1 | Test 2 | Test 3 | Test 4 |
|---|---|---|---|---|
| Applicability of this mode for use | No | No | No | No |

It can be argued that the operating mode of "Power only while Puff" may be practically inapplicable for use due to the inertia of bodies that need to be heated to a given temperature in a short period of time. Therefore, vapor can be obtained only on the fifth puff.

Operating Mode "Preheat and Power while Session"

Test results related to this operating mode are presented in Table 3, Table 4, Table 9, and Table 10. The results presented in these tables indicate that operating the heater in the "Pre Heat and Power while Session" mode allows the substrate to warm up before the smoking session begins. Stabilization of the heater temperature at a given level throughout the session made it possible to achieve relatively fast Vape production.

As a result, when using a heater without a multichannel air duct, Vapor can be obtained already at 2 puffs in the variant when the heater is not placed in a plastic case (Table 3). In test No. 4 (4), when the heater is placed in a plastic case (Table 3), Vapor can also be obtained at 2 puffs.

The thermal insulation qualities of the heater operating in the mode "Preheat and Power while Session" can be judged by comparing the data from Table 3-Table 9, and Table 4-Table 10, respectively.

As can be seen from Table 3 (Test 4) the temperature difference between the inside of the heater and its outer surface of the heat exchanger is about 169-184 degrees. As can be seen from Table 4 (Test 4), the temperature difference between the inside of the heater and its outer surface is of the heat exchanger 160-170 degrees C., and the temperature on the outer surface of the plastic case is 51 degrees.

This is an excellent and impressive thermal insulation result. Below are tables where the parameters of the temperature indicators of the corresponding tests are shown for comparison.

TABLE 3

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1800-7425 | 1818- | 1716-7500 | 1805-8430 |
| Iqos Vape output (Conventional | | 1800-6281 | | |
| Vape generation occurs, puff No | 2 | 2 | 2 | 2 |
| Temperature PID | 225 | 230 | 240 | 260 |
| Preheat time, sec. | 5 | 5 | 10 | 20 |
| Heater internal temperature, C. | 215-230 | 225-240 | 235-250 | 255-270 |
| Heater outer temperature, C. (Max) | 72 | 79 | 80 | 86 |
| Voltage, V | 4.2 | 4.2 | 4.2 | 4.2 |
| Optimal internal temperature, C. | | 230-235 | | |
| Organoleptic test | Good taste | Good taste | Good taste | Slightly overheated |
| Applicability of this mode for use | Yes | Yes | Yes | No |

TABLE 4

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1810-6280 | 1830- | 1815-7620 | 1820-8870 |
| Iqos Vape output (Conventional | 1800-6281 | | | |
| Vape generation occurs, puff No | 2 | 2 | 2 | 2 |
| Temperature PID | 225 | 230 | 240 | 260 |
| Preheat time, sec. | 5 | 5 | 10 | 20 |
| Heater internal temperature, C. | 220-225 | 225-240 | 230-250 | 250-260 |
| Heater outer temperature, C. (Max) | 78 | 81 | 85 | 90 |
| Voltage, V | 4.2 | 4.2 | 4.2 | 4.2 |
| Optimal internal temperature, C. | 225-235 | | | |
| Organoleptic test | Good taste | Good taste | Slightly overheated | Slightly overheated |
| Applicability of this mode for use | Yes | Yes | No | No |

TABLE 9

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1810-5875 | 1800- | 1800-6910 | 1800-7650 |
| Iqos Vape output (Conventional | 1800-6281 | | | |
| Vape generation occurs, puff No | 4 | 4 | 4 | 3 |
| Temperature PID | 220 | 225 | 240 | 260 |
| Preheat time, sec. | 5 | 5 | 10 | 10 |
| Heater internal temperature, C. | 225 | 230 | 240 | 260 |
| Heater outer temperature, C. (Max) | 225 | 230 | 240 | 260 |
| Voltage, V | 4.2 | 4.2 | 4.2 | 4.2 |
| Optimal internal temperature, C. | 230-235 | | | |
| Organoleptic test | Good taste | Good taste | Good taste | Slightly overheated |
| Applicability of this mode for use | No | No | No | No |

TABLE 10

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1800-5660 | 1800- | 1800-8380 | 1800-9890 |
| Iqos Vape output (Conventional | 1800-6281 | | | |
| Vape generation occurs, puff No | 4 | 3 | 3 | 2 |
| Temperature PID | 225 | 230 | 240 | 260 |
| Preheat time, sec. | 5 | 5 | 10 | 10 |
| Heater internal temperature, C. | 231 | 236 | 247 | 266 |
| Heater outer temperature, C. (Max) | 231 | 236 | 247 | 266 |
| Outer temperature at the Case, C. | 54 | 56 | 60 | 60 |
| Voltage, V | 4.2 | 4.2 | 4.2 | 4.2 |
| Optimal internal temperature, C. | 230-235 | | | |
| Organoleptic test | Good taste | Good taste | Good taste | Slightly overheated |
| Applicability of this mode for use | No | No | No | No |

It can be argued that this mode of operation "Preheat and Power while Session" is the best for using the heater. When using a heater with a multichannel air duct, the Vape can be obtained for the second and third puffs, but its taste is slightly overheated. Therefore, we believe that the best temperature for heater operation is 230-235 degrees Celsius. However, at this temperature, the heater without the multichannel air duct produces Vape on the third and fourth puffs (Tab. 9 and Tab. 10).

From this it can be concluded that the heater with a multichannel duct produces steam earlier and has good thermal insulation and energy-saving properties.

Operating Mode "Preheat and Power Forsage while Session"

Test results related to this operating mode are presented in Table 5, Table 6, Table 11, and Table 12.

The results in these tables indicate that operating the heater in the "Preheat and Power Forsage while Session" mode allows the substrate to warm up before the smoking session begins. The stabilization of the heater temperature at a given level throughout the session is maintained at 180-200 degrees. When tightening, the supply voltage rises, and accordingly, the heating temperature of the tobacco substrate rises during the tightening. As demonstrated by tests in the operating mode of "Preheat and Power Forsage while Session", Vape was obtained only at the fifth puff, which is not a satisfactory result.

The thermal insulation qualities of the heater operating in this mode can be evaluated by comparing the data from Table 5-Table 11, and Table 6-Table 12, respectively.

As can be seen from Table 5 (Test 4) the temperature difference between the inside of the heater and its outside surface (the outer surface of the heat exchanger) is about 197 degrees. As can be seen from Table 6 (Test 4), the temperature difference between the inside of the heater and its outer surface (the outer surface of the heat exchanger) is 204 degrees, and the temperature on the outer surface of the plastic case is 45 degrees.

Below are tables where the parameters of the temperature indicators of the corresponding tests are shown comparison.

TABLE 5

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1800-4246 | 1800- | 1800-6500 | 1800-6973 |
| Iqos Vape output (Conventional | | 1800-6281 | | |
| Vape generation occurs, puff No | 7 | 6 | 6 | 5 |
| Temperature PID | 250 | 250 | 250 | 250 |
| Preheat time, sec. | 10 | 10 | 10 | 10 |
| Preheat temperature, C. | 200 | 180 | 190 | 200 |
| Heater internal temperature, C. | 250 | 267 | 268 | 270 |
| Heater outer temperature, C. (Max) | 64 | 71 | 72 | 73 |
| Voltage, V | 4.2 | 6 | 6 | 6 |
| Optimal internal temperature, C. | | 250 | | |
| Organoleptic test | Good taste | Good | Good taste | Good taste |
| Applicability of this mode for use | No | No | No | No |

TABLE 6

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1800-4160 | 1790- | 1800-5990 | 1785-6885 |
| Iqos Vape output (Conventional | | 1800-6281 | | |
| Vape generation occurs, puff No | 7 | 6 | 6 | 5 |
| Temperature PID | 250 | 250 | 250 | 250 |
| Preheat time, sec. | 10 | 10 | 10 | 10 |
| Preheat temperature, C. | 200 | 180 | 190 | 200 |
| Heater internal temperature, C. | 250 | 268 | 270 | 270 |
| Heater outer temperature, C. (Max) | 66 | 64 | 65 | 66 |
| Outer temperature at the Case, C. | 44 | 44 | 45 | 45 |
| Voltage, V | 4.2 | 6 | 6 | 6 |
| Optimal internal temperature, C. | | 250 | | |
| Organoleptic test | Good taste | Good | Good taste | Good taste |
| Applicability of this mode for use | No | No | No | No |

TABLE 11

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1805-4616 | 1805- | 1805-6025 | 1800-6020 |
| Iqos Vape output (Conventional | | 1800-6281 | | |
| Vape generation occurs, puff No | 6 | 6 | 5 | 5 |
| Temperature PID | 250 | 250 | 250 | 250 |
| Preheat time, sec. | 10 | 10 | 10 | 10 |
| Preheat temperature, C. | 200 | 180 | 190 | 200 |
| Heater internal temperature, C. | 250 | 265 | 270 | 275 |
| Heater outer temperature, C. (Max) | 250 | 250 | 270 | 275 |
| Voltage, V | 4.2 | 6 | 6 | 6 |
| Optimal internal temperature, C. | | 275 | | |
| Organoleptic test | Good taste | Good | Good taste | Good taste |

TABLE 11-continued ("Heater Outer Temperature" refers to Heat Exchanger Outer Temperature):

| Parameter | Test 1 | Test 2 | Test 3 | Test 4 |
|---|---|---|---|---|
| Applicability of this mode for use | No | No | No | No |

TABLE 12

("Heater Outer Temperature" refers to Heat Exchanger Outer Temperature):

| Parameter | Test 1 | Test 2 | Test 3 | Test 4 |
|---|---|---|---|---|
| Snail Vape output (Conventional | 1800-4065 | 1800- | 1800-4380 | 1800-4380 |
| Iqos Vape output (Conventional | | 1800-6281 | | |
| Vape generation occurs, puff No | 6 | 6 | 5 | 5 |
| Temperature PID | 250 | 250 | 250 | 250 |
| Preheat time, sec. | 10 | 10 | 10 | 10 |

TABLE 12-continued ("Heater Outer Temperature" refers to Heat Exchanger Outer Temperature):

| Parameter | Test 1 | Test 2 | Test 3 | Test 4 |
|---|---|---|---|---|
| Preheat temperature, C. | 200 | 180 | 190 | 200 |
| Heater internal temperature, C. | 244 | 247 | 261 | 259 |
| Heater outer temperature, C. (Max) | 244 | 247 | 261 | 259 |
| Outer temperature at the Case, C. | 48 | 47 | 46 | 49 |
| Voltage, V | 4.2 | 6 | 6 | 6 |
| Optimal internal temperature, C. | | 259 | | |
| Organoleptic test | Good taste | Good | Good taste | Good taste |
| Applicability of this mode for use | No | No | No | No |

Stress Test Result

The Stress Test was performed in the Operating mode "Preheat and Power while Session". In this case, the heater was installed in a plastic case. 70 pcs the HEETS (Philip Morris heatsticks) cigarette sticks were smoked. During the tests, the "Snail" heater worked normally. It was noted that the HEET is not an optimal tobacco stick for use with the heat exchanger. This is because heat exchanger uses a circumfrential (non-penetrative heater), whereas the HEET is designed for use with the penetrative knife blade of the IQOS system. As a result, the HEET contains a heat reflective material inside the tipping paper to retain the heat emanating from the knife blade; but such material is actually unhelpful with a circumfrential heater.

CONCLUSION

The "Snail" heater has effective thermal insulation properties and can be used as a heater for heat not burn devices. It is observed that the "Snail" heater has good results especially in the "Preheat and Power while Session" operating mode. In the "Power only while Puff" and "Preheat and Power Forsage while Session" operating modes, the delay in steam production may be too long.

Example B: Comparison of IQOS and "Snail" Evaporated Mass

This test compared IQOS 3 with the Snail heater of the present invention. The following puff conditions were employed: 12 Puffs; puff volume 55 ml; puff time 3 seconds; and puf frequency every 30 seconds. Both devices employed a Philip Morris, Marlboro heatstick.

The IQOS 3 device had an average heater temperature of 290 C, with an average evaporated mass of 6.4 mg. The "Snail" device of the present invention had an average heater temperature of 230 C, with an average evaporated mass of 7.6 mg. This means that the snail device produced am average evaporated mass of 18% greater than IQOS 3, with an average heater temperature of 60 degrees C. lower, or 20.6% lower average heater temperature.

It was noted that the above results are superior to the state of the art IQOS 3 and are achieved without a penetrative heater. In certain embodiments, the present invention produces (when measured at the above conditions), an average evaporated mass of 5 mg or greater, preferably 6 mg or greater, more preferably 7 mg or greater, and even more preferably, 8 mg or greater. These average evaporated mass numbers are achieved with a heater temperature at or below 260° C., preferably below at or below 250° C., more preferably at or below 240° C., and even more.

Example C: Design of a Snail Heater which Comprises a Mono Channel Air Duct

The present Example generally relates to another embodiment of the Snail heater wherein the said embodiment comprises a mono channel air duct (also referred to herein as "channel" or "duct"). While a snail shape can be used with a mon-channel air duct system, this embodiments relates to a series of channels that run nearly the length of the heat exchanger.

BACKGROUND

An embodiment of the Snail heater comprising a multichannel duct is discussed herein (see Example A). Generally, the Snail heater with a multichannel duct has good energy-saving qualities. This is at least partly because the Snail heater body is made of heat-resistant film material. The multichannel duct comprises two air ducts through which air enters the heating chamber from the outside. Thus, the desired temperature is derived from the heated structural elements, and the heated air enters the substrate (such as substrate of a plant matter) of the cigarette. The heat transfer in the multichannel duct Snail heater is schematically illustrated in FIG. 1.

The Mono Channel Air Duct Heater Exchanger

In a preferred embodiment, the mono channel heater has one channel for the passage of air flow. The channel runs along the entire (or a substantial portion of the) length of the heat exchanger—from the inlet for the air intake to the entry to the heating chamber. In some embodiments, the channel has a cross-section that provides sufficient air passage when inhaling while allowing efficient heat intake from the structural elements. In some embodiments, this is achieved by allowing the air to move along the duct, from the outer surface to the center, while also moving along a labyrinth formed by an internal septum, or septa. In certain embodiments, the labyrinth is comprised of a series of connected vertical (or near vertical channels), such channels running nearly the length of the heat exchanger, and the first vertical channel leading into a "turn" which leads to a second vertical channel with the airflow running the opposite direction. For example, vertically down airflow, followed by vertically up airflow, followed by vertically down airflow, and so on. The heat exchanger may comprise more than three turns, preferably more than four turns, more preferably more than five turns, still more preferably more than six turns, most preferably, more than seven turns. Each turn corresponds to a septum, the preceding disclosure can be thought of more than three septa, and so forth.

In a different embodiment, two air channels can be used with the septa design, where the two air channels are overlaid, either in the thickness direction, or the the air channels alternating. There is no specific limit on the number of air channels; two, three, four or more may be employed.

In a still difference embodiment, a mono-channel septa design can be used where the septa roll onto themselves, having a mono-channel design that spirals onto itself.

Advantageously, the presently disclosed design of the mono channel air duct heat exchanger may result in less heating of the heat exchanger's outer body while still efficiently preheating the air that enters the tobacco substrate of the cigarette stick. Thus, the mono channel air duct Snail heater offers efficient heat management by increasing the level of heat recuperation from the heated Snail heater body and achieving a temperature decrease on the outer surfaces of the Snail heater body.

Detailed Description of the Mono Channel Air Duct Heat Exchanger

An embodiment of the mono channel air duct heat exchanger is schematically illustrated in FIG. 18. Generally, the mono channel air duct heat exchanger comprises the following structural elements: heating chamber, film heat-resistant material, septa 30, labyrinth duct 32. inlet 29, heater. The pattern of air flow in an embodiment of the mono channel air duct heat exchanger is schematically illustrated in FIG. 18. The pattern of air flow in an embodiment of the mono channel air duct heat exchanger is further schematically illustrated in FIG. 13, wherein the heat exchanger's air duct is illustrated in an exploded, unrolled, view. The arrows show the air direction from the inlet hole.

Figure 3:
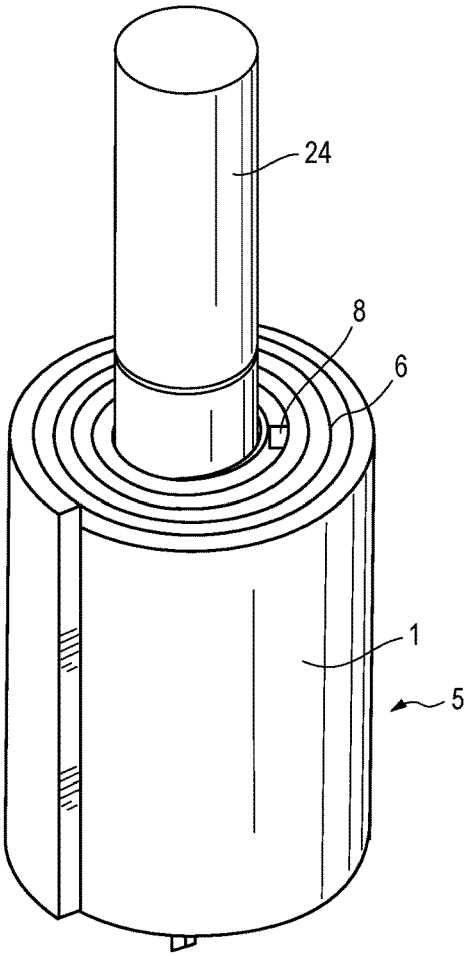
FIG. 3 illustrates another top and side perspective view of the heat exchanger for the vaporizer device with the air preheating element with a tobacco stick.
Figure 4:
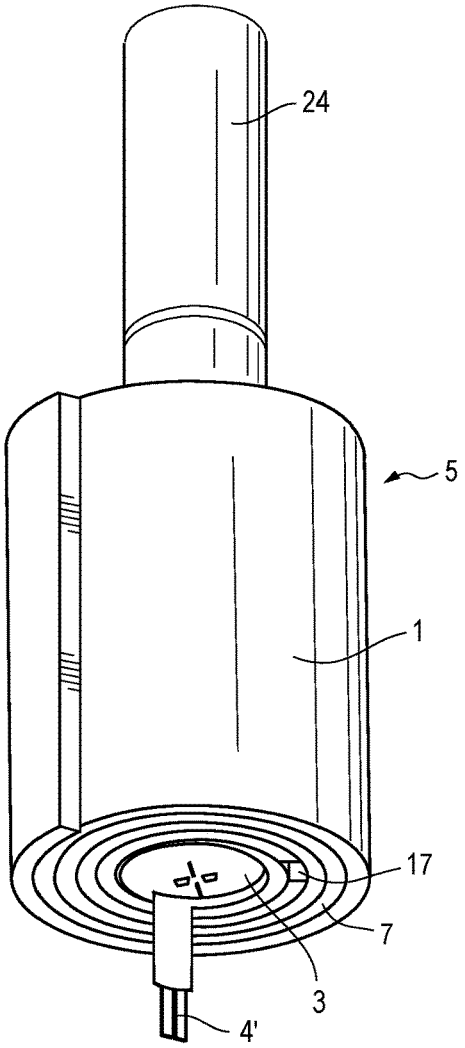
FIG. 4 illustrates another bottom and side perspective view of the heat exchanger for the vaporizer device with the air preheating element with a tobacco stick.

Generally, the mono channel air duct heat exchanger is a cylinder which is formed by rolling (see FIG. 3). The heating chamber is in the center of the cylinder, into which a cigarette stick may be installed. The mono channel air duct heat exchanger comprises a film heat-resistant material. The film heat-resistant material comprises at least one septum 30, the at least one septum 30 forming a labyrinth duct 31. The labyrinth duct 4 comprises an inlet 29 through which the outside air enters the duct. In some embodiments, the inlet is generally located on the upper side of the mono channel air duct heat exchanger. In some other embodiments, the inlet is be located at the bottom of the mono channel air duct heat exchanger. It is contemplated that both embodiments have the same efficiency and have no advantage over each other. In a preferred embodiment, the inlet 5 is located as far as possible from the heating chamber.

A resistive heater is located on the outside of the heating chamber. Generally, heating chamber enwraps the entire part of a cigarette stick which contains tobacco, or any other substrate for smoking. The heater does not necessarily come into direct contact with the cigarette stick, but the heat, required for heating the tobacco substrate, is transferred through the wall of the cylindrical heating chamber. In the lower part of the heating chamber there are openings through which the preheated air flows from the duct into the heating chamber.

In some embodiments, the mono channel air duct heat exchanger comprises a limiter, generally located in its lower part, which serves to ensure the correct position of the cigarette stick inside the heating chamber. In a preferred embodiment, the limiter is located in such a way that it does not interfere with the passage of preheated air into the substrate of the cigarette stick.

In conclusion, the principle of operation of the mono channel air duct heat exchanger is similar to that of the multichannel duct spiral heat exchanger. When puffing, air enters the air duct of the Snail heater, and when passing through the air ducts it is heated due to the extraction of heat from the solid elements. The heated air then enters the substrate chamber of the cigarette stick. Subsequently, the vapor, enriched with the active substance derived from the heated substrate, enters the condenser of the cigarette stick. The vapor then passes through the filter and enters the smoker's mouth.

The heat exchanger does not need to be symmetrical in design, or cylindrical. The septa are typically perpendicular to the bottom plane of the heat exchanger. However, in other embodiments, the septa may be angled with respect to the bottom of the heat exchanger. The turns are optionally at right angles; the turns also be curved.

Study Comparing Impact of Different Air Duct Configurations (Using Mono-Channel Design)

The configuration of air ducts inside the heat exchanger can affect the distribution of the air temperature, which optimally is directed into the tunnel. Our modeling demonstrated that by optimizing the air duct configuration, we reduce heat loss during operation, and get better heat recovery and higher air temperatures at the entrance to the tunnel into the tobacco stick, with attendant energy efficiency gains.

The purpose of this study was to compare the impact of different air duct configurations (using a mono-channel design) on the flow of internal thermodynamic and recuperative processes.

Four designs were modeled: first, a mono-channel heat exchanger with uniformly-sized air channels (design 2.5); second, a mono-channel heat exchanger with cyclic reduction of the air channel width from the outside to the center (design 2.6); third, a mono-channel heat exchanger with increasing air channel width from outside to center (design 2.7); and fourth, a spiral heat exchanger (design 1).

The following operating conditions were assumed for purposes of calculations: heater temperature 240 C; air velocity during puff 0.5 m/s; Ambient air temperature 25 C; Puff time 3 seconds; Pause between puffs 27 seconds; Number of puffs 6 puffs.

Temperature modeling demonstrated that design 2.7 (a mono-channel heat exchanger with increasing air channel width from outside to center) had the lowest average temperature on the outside of the heat exchanger while maximizing temperature in the tunnel. The design 2.7 air channel design prevents the removal of air from the center to the outside; the air inside moves to the center with a gradual decrease in speed due to the increase in air channel width. As a result, the time required for the air to pass from the air inlet to the heater was increased, allowing the air to heat up before direct contact with the heater. It was noted that increasing channel width may also be employed advantageously with multi-channel designs.

Design 2.6 was less optimal for the converse reason; the air constantly increased its speed due to the reduction of the channel area. As a result, the temperature performance suffered.

Additionally, when designing a mono-channel heat exchanger with certain air ducts, it is advisable to avoid the arrangement of septa in a line (or substantially avoid such a configuration), as such arrangement of the septa (in a line) may lead to additional heat transfer from the center to the outer wall of heat exchanger.

What is claimed is:

1. A heat exchanger for heating a tobacco stick and for preheating air before it passes through a tobacco stick, comprising:

a roll or winding comprising a plurality of layers of rolled or wound thin-film material, the roll or winding having a hollow core forming a tunnel extending at least partially through a longitudinal rolling or winding axis of the roll or winding for receiving a tobacco stick, the layers of rolled or wound thin-film material being separated by spacers forming interconnected air flow channels between adjacent layers of the rolled or wound thin-film material;

a resistive heating element provided on an inner layer of the thin-film material adjacent the tunnel;

at least one inlet hole configured to intake air into at least one of the air flow channels; and at least one outlet hole communicating at least one other of the air flow channels with the tunnel.

2. The heat exchanger according to claim 1, wherein the at least one inlet hole communicates with at least a first air flow channel adjacent the tunnel, the first air flow channel extending spirally outwardly from the inlet hole towards an outer layer of the thin-film material, the first air flow channel communication with a second air flow channel extending spirally inwardly from the an outer layer of the thin-film material towards the outlet hole communicating with the tunnel.

3. The heat exchanger according to claim 1, wherein the at least one air flow channel between adjacent layers of the rolled or wound thin-film material has first portions extending in a first direction parallel to the longitudinal rolling or winding axis of the roll or winding, second portions extending in a second direction opposite the first direction and parallel to the longitudinal rolling or winding axis of the roll or winding, and third portions connecting the first and second portions; wherein the at least one inlet hole communicates with at least one air flow channel between adjacent outer layers of the rolled or wound thin-film material, and the at least one air flow channel extends spirally inwardly from the an outer layers towards the outlet hole communicating with the tunnel.

4. The heat exchanger according to claim 1, wherein a volume of the interconnected air flow channels is 500 $mm^3$ to 1000 $mm^3$.

5. The heat exchanger according to claim 1, wherein a volume of the interconnected air flow channels is 300% to 600% percent larger than a volume of the tunnel.

6. The heat exchanger according to claim 1, wherein a volume of the interconnected air flow channels is 2500 to 6000 $mm^3$.

7. The heat exchanger according to claim 1, wherein further comprising a control module configured to control an operating temperature of the resistive heating element so that operating temperature of the resistive heating element and and an outside surface of the heat exchanger during operation have a temperature differential of greater than 150° C.

8. The heat exchanger according to claim 1, further comprising a control module configured to control an operating temperature of the resistive heating element and so that operating temperature of the resistive heating element and an outside surface of the heat exchanger during operation have a temperature differential of greater than 190° C., wherein the heat exchanger does not comprise vacuum insulation.

9. The heat exchanger according to claim 1, further comprising a control module configured to control the heat exchanger is to employ forsage during each puff.

10. The heat exchanger according to claim 1, further comprising a penetrative heater configured to penetrate a portion of a tobacco stick to be inserted in the tunnel.

11. The heat exchanger according to claim 1, wherein the heat exchanger, when used with a tobacco stick, achieves an evaporated mass per puff average of 7 mg per session, with a heater temperature of 230 C or below; measured using a puff volume 55 ml; puff time 3 seconds; and puff frequency every 30 seconds, over a total of 12 puffs.

12. The heat exchanger according to claim 1, wherein walls of the tunnel have an upward slope from a base portion within the tunnel towards an open end.

13. The heat exchanger according to claim 1, wherein the heat exchanger includes two spiral air flows.

14. The heat exchanger according to claim 1, wherein the heat exchanger includes non-spiral airflow and a mono-channel duct with at least four septa.

15. The heat exchanger according to claim 1, wherein the resistive heating element comprises a high-resistivity metal including at least one of a nichrome and a FeCrAl alloy, and a low-resistivity metal including at least one of a stainless steel, nickel or titanium.

16. The heat exchanger according to claim 1, further comprising a seat provided at a bottom of the tunnel, with the seat having wall holes and a top axial hole for intake of air preheated by the heater exchanger into the tunnel.

17. The tobacco stick heating device comprising the heat exchanger according to claim 1 in an outer housing, and further comprising a battery.

18. The tobacco stick heating device of claim 17, wherein an outer surface of the heat exchanger does not, during a vaping session, reach a temperature of greater than 50° C.

19. The tobacco stick heating device of claim 17, wherein the outer surface of the heat exchanger does not, during a vaping session, reach an operating temperature of more than 45% of the operating temperature of the heating element.

20. The tobacco stick heating device of claim 17, comprising a mono-channel heat exchanger with increasing air channel width from outside to center.

21. A thin-film material in tape form for forming a heat exchanger for heating a tobacco stick and for preheating air before it passes through a tobacco stick, comprising:

a thin-film material in tape form;

a resistive heating element provided at one end of the thin-film material in tape form;

at least one first spacer raised from a surface of and provided at a periphery of the thin-film material in tape form; and at least one second spacer raised from a surface of the thin-film material in tape form and dividing the thin-film material in tape form into at least two portions.

22. A method of producing a heat exchanger for heating a tobacco stick and for preheating air before it passes through a tobacco stick, comprising winding thin-film material in tape form according to claim 21 around a core, with the one end adjacent the core.

* * * * *